US011586119B2

(12) United States Patent
Suzuki et al.

(10) Patent No.: US 11,586,119 B2
(45) Date of Patent: Feb. 21, 2023

(54) ELECTROPHOTOGRAPHIC PHOTOCONDUCTOR, METHOD OF MANUFACTURING THE SAME, AND ELECTROPHOTOGRAPHIC DEVICE

(71) Applicant: FUJI ELECTRIC CO., LTD., Kawasaki (JP)

(72) Inventors: Shinjiro Suzuki, Matsumoto (JP); Fengqiang Zhu, Matsumoto (JP); Masaru Takeuchi, Matsumoto (JP); Tomoki Hasegawa, Hino (JP)

(73) Assignee: FUJI ELECTRIC CO., LTD., Kawasaki (JP)

( * ) Notice: Subject to any disclaimer, the term of this patent is extended or adjusted under 35 U.S.C. 154(b) by 0 days.

(21) Appl. No.: 17/162,334

(22) Filed: Jan. 29, 2021

(65) Prior Publication Data

US 2021/0271179 A1 Sep. 2, 2021

(30) Foreign Application Priority Data

Mar. 2, 2020 (JP) ..... JP2020-035250

(51) Int. Cl.

| | |
|---|---|
| ***G03G 5/047*** | (2006.01) |
| ***G03G 5/06*** | (2006.01) |
| ***G03G 5/05*** | (2006.01) |

(52) U.S. Cl.

CPC ..... *G03G 5/047* (2013.01); *G03G 5/0525* (2013.01); *G03G 5/0567* (2013.01); (Continued)

(58) Field of Classification Search

CPC .... G03G 5/047; G03G 5/0525; G03G 5/0567; G03G 5/0582; G03G 5/0614; G03G 5/062

See application file for complete search history.

(56) References Cited

U.S. PATENT DOCUMENTS

| | | | | |
|---|---|---|---|---|
| 5,213,924 | A | 5/1993 | Sakamoto | |
| 2018/0224760 | A1* | 8/2018 | Suzuki | G03G 5/0578 |
| 2018/0275537 | A1 | 9/2018 | Hasegawa et al. | |
| 2019/0163077 | A1 | 5/2019 | Takeuchi et al. | |
| 2019/0346780 | A1 | 11/2019 | Zhu et al. | |

FOREIGN PATENT DOCUMENTS

| | | | |
|---|---|---|---|
| JP | S6162040 | A | 3/1986 |
| JP | H03273256 | A | 12/1991 |
| JP | H04179961 | A | 6/1992 |
| JP | 2004085644 | A | 3/2004 |
| JP | 2004354759 | A | 12/2004 |
| JP | 2008176054 | A | 7/2008 |
| JP | 2016009066 | A | 1/2016 |
| WO | 2018003229 | A1 | 1/2018 |
| WO | 2018150693 | A1 | 8/2018 |
| WO | 2019159342 | A1 | 8/2019 |

* cited by examiner

*Primary Examiner* — Peter L Vajda
*Assistant Examiner* — Boone Alexander Evans
(74) *Attorney, Agent, or Firm* — Rabin & Berdo, P.C.

(57) ABSTRACT

Provided are an electrophotographic photoconductor being resistant to abrasion even in long-term use, having highly sensitive electric characteristics, being capable of maintaining a high retention rate, and being capable of providing a stable image without filming, a method of manufacturing the same, and an electrophotographic device. The photoconductor includes an electroconductive substrate (1), a charge generation layer (3), and a charge transport layer (4); the charge transport layer contains a hole transport material, a resin binder, an electron transport material, and an inorganic oxide; the charge generation layer contains a charge generation material; the masses of the hole transport material, the resin binder, the electron transport material, and the inorganic oxide in the charge transport layer respectively denoted by a to d satisfy $1.5 \leq b/a \leq 5.7$, $0.005 \leq c/a \leq 0.35$, $0.05 \leq d/a \leq 0.70$, $a \geq c+d$, and $c/d \geq 0.01$; the hole transport material contains a compound expressed by formula (A-1); (Continued)

and the charge generation material contains titanyl phthalocyanine having an exothermic peak at 251±5° C., a half-value width of the exothermic peak equal to or less than 15° C., and a heating value equal to or greater than 1.0 mJ/mg when a temperature rise condition is 20° C./min in differential scanning calorimetry, and having an X-ray diffraction peak at 27.2±0.3°.

(A-1)

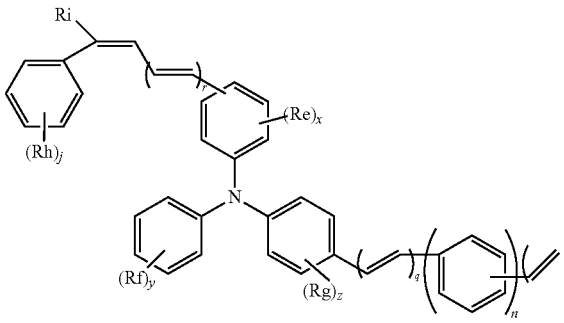

-continued

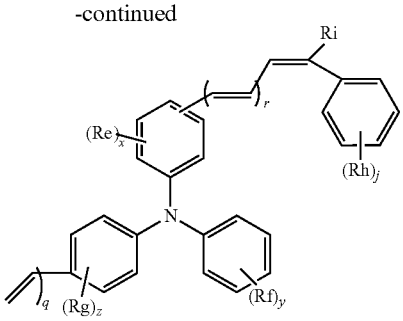

19 Claims, 6 Drawing Sheets

(52) U.S. Cl.
CPC ..... *G03G 5/0582* (2013.01); *G03G 5/062* (2013.01); *G03G 5/0614* (2013.01)

CGM1

CGM2

CGM3

CGM4

CGM5

CGM6

ELECTROPHOTOGRAPHIC PHOTOCONDUCTOR, METHOD OF MANUFACTURING THE SAME, AND ELECTROPHOTOGRAPHIC DEVICE

CROSS-REFERENCE TO A RELATED APPLICATION

This non-provisional application for a U.S. patent claims the benefit of priority of JP 2020-035250 filed Mar. 2, 2020, DAS code No. D4D5, the entire contents of which is hereby incorporated by reference.

TECHNICAL FIELD

The present invention relates to an electrophotographic photoconductor (hereinafter also simply referred to as a "photoconductor") used in electrophotographic printers, copiers, fax machines, and the like, a method of manufacturing the same, and an electrophotographic device. The present invention particularly relates to an electrophotographic photoconductor capable of achieving excellent abrasion resistance and electric characteristic stability by containing a specific charge transport material and a specific charge generation material in a photosensitive layer, a method of manufacturing the same, and an electrophotographic device.

BACKGROUND ART

A basic structure of an electrophotographic photoconductor is a structure in which a photosensitive layer having a photoconduction function is formed on an electroconductive substrate. In recent years, research and development of organic electrophotographic photoconductors using organic compounds as functional components responsible for generation and transport of charges have been actively promoted due to advantages such as diversity of materials, high productivity, and safety, and application of such organic electrophotographic photoconductors to copiers, printers, and the like is in progress.

A photoconductor is generally required to have a function of retaining surface charges in a dark place, a function of receiving light and generating charges, and a function of transporting generated charges. A photosensitive layer plays the roles. Photoconductors are classified into a so-called single-layer photoconductor and a multilayer (function-separated) photoconductor depending on a form of a photosensitive layer. The single-layer photoconductor includes a single-layer photosensitive layer having both the charge generation function and the charge transport function. The multilayer photoconductor includes a photosensitive layer in which a charge generation layer and a charge transport layer are laminated. The charge generation layer is mainly responsible for the function of charge generation at light reception. The charge transport layer is responsible for the function of retaining surface charges in a dark place and the function of transporting charges generated in the charge generation layer at light reception.

The photosensitive layer is generally formed by applying a coating liquid in which a charge generation material, a charge transport material, and a resin binder are dissolved or dispersed in an organic solvent to an electroconductive substrate. Use of polycarbonate having resistance against friction occurring with paper or a blade for toner removal, excellent flexibility, and excellent transparency in exposure as a resin binder in a layer particularly being the outermost surface of the organic electrophotographic photoconductor is often observed. In particular, bisphenol-Z polycarbonate is widely used as a resin binder. For example, a technology using such polycarbonate as a resin binder is described in Patent Document 1 and the like.

Further, with increase in a number of printed sheets due to networking in offices, rapid development of light-weight printers by electrophotography, and the like, high abrasion resistance, that is, high durability, and high sensitivity and high responsiveness are increasingly demanded of electrophotographic printing devices in recent years.

Furthermore, with recent development of and a recently increased penetration rate of color printers, acceleration of printing speed, and downsizing of and reduction in a part count of a device are in progress, and accommodation to various use environments is demanded. In such a situation, demands for a photoconductor with smaller variations in image characteristics and electric characteristics caused by repeated use and variations in a use environment (room temperature and an environment) are remarkably increasing, and conventional technologies can no longer sufficiently satisfy the demands at the same time.

In order to solve the problems, various methods for improving the outermost surface layer of a photoconductor have been proposed.

Various polycarbonate resin structures are proposed in order to improve durability of a photoconductor surface. For example, while Patent Documents 2 to 4 propose polycarbonate resins including specific structures, there is a problem that compatibility with various types of charge transport agents and additives, and solubility of resin are not sufficiently examined, and that it is difficult to stably sustain electric characteristics in long-term use. Further, while Patent Document 5 also proposes a polycarbonate resin including a specific structure, there are many spaces between polymers in a resin with a bulky structure, and a discharge substance, a contact member, a foreign substance, and the like at charging are likely to penetrate a photosensitive layer; and therefore it is difficult to acquire sufficient durability due to occurrence of a filming phenomenon being adherence of toner to a photosensitive layer, and the like. Furthermore, while Patent Document 6 proposes making a photosensitive layer contain filler particles for improvement of abrasion resistance, an effect of aggregation of particles at production of a photosensitive layer coating liquid on photoconductor characteristics and an effect of the filming phenomenon being adherence of a toner component to a photoconductor due to affinity between aggregates and the toner component are not sufficiently examined.

In order to cope with the problems, use of a combination of materials with specific structures as described in Patent Documents 7 to 9 in a photosensitive layer has been proposed.

On the other hand, Patent Document 10 proposes a method of forming, on the outermost surface of a photosensitive layer, a surface layer containing a curable resin being a curable substance containing a compound having a bridged structure and a charge transportable structure. However, in this case, the surface layer is additionally provided on the photosensitive layer, and therefore there is a risk that charge transportability decreases due to increase in a production man-hour and increase in the number of interfaces, and acquisition of sufficient sensitivity becomes difficult.

RELATED ART DOCUMENTS

Patent Documents

Patent Document 1: JPS61-62040A
Patent Document 2: JP2004-354759A

Patent Document 3: JPH04-179961A

Patent Document 4: JPH03-273256A

Patent Document 5: JP2004-085644A

Patent Document 6: JP2008-176054A

Patent Document 7: WO 2018/003229A1

Patent Document 8: WO 2019/159342A1

Patent Document 9: WO 2018/150693A1

Patent Document 10: JP2016-009066A

SUMMARY OF THE INVENTION

Problems to be Solved by the Invention

As described above, various technologies related to improvement of the outermost surface layer of a photoconductor has been previously proposed. However, technologies described in the patent documents are not sufficient in every aspect of durability, electric characteristics, abrasion resistance, an image defect caused by filming, and the like in long-term actual use.

In view of the above, an object of the present invention is to provide an electrophotographic photoconductor being resistant to abrasion even in long-term use, having highly sensitive electric characteristics, being capable of maintaining a high retention rate, and being capable of providing a stable image without filming, a method of manufacturing the same, and an electrophotographic device.

Means for Solving the Problems

As a result of intensive studies about materials of a photosensitive layer for solving the aforementioned problem, the present inventors provide a photoconductor having improved abrasion resistance and filming resistance, high sensitivity, a reduced amount of decrease in a potential retention rate in repeated use, and excellent stability. Specifically, the present inventors found out that an excellent electrophotographic photoconductor is acquired by applying structures as described below and brought the present invention to completion.

Specifically, a first aspect of the present invention is an electrophotographic photoconductor including:

an electroconductive substrate; and a photosensitive layer provided on the electroconductive substrate and successively including:

a charge generation layer containing a charge generation material disposed on the electroconductive substrate; and a charge transport layer disposed on the charge generation layer and containing a hole transport material having a mass denoted by a and a structure expressed by general formula (A-1) below, a resin binder having a mass denoted by b, an electron transport material having a mass denoted by c, and an inorganic oxide having a mass denoted by d, and a, b, c, and d satisfy conditions expressed by equations 1 to 5 below:

$1.5 \leq b/a \leq 5.7$, equation 1

$0.005 \leq c/a \leq 0.35$, equation 2

$0.05 \leq d/a \leq 0.70$, equation 3

$a \geq c+d$, and equation 4

$c/d \geq 0.01$, equation 5 wherein the charge generation material contains titanyl phthalocyanine having an exothermic peak at 251±5° C., a half-value width of the exothermic peak equal to or less than 15° C., and a heating value equal to or greater than 1.0 mJ/mg when a temperature rise condition is 20° C./min in differential scanning calorimetry and having a diffraction peak at 27.2±0.3° in X-ray diffraction, and wherein the structure expressed by general formula (A-1) is:

(A-1)

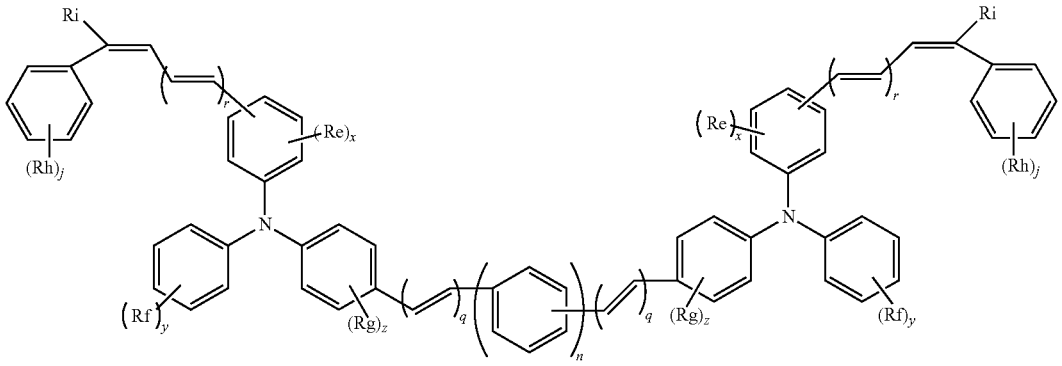

where, each of Re, Rf, Rg, and Ri independently represents a hydrogen atom, a branched or unbranched alkyl group having 1 to 6 carbon atoms, an alkoxy group having 1 to 3 carbon atoms, a substituted or unsubstituted phenyl group, or a substituted or unsubstituted styryl group, Rh represents a hydrogen atom, a branched or unbranched alkyl group having 1 to 6 carbon atoms, an alkoxy group having 1 to 3 carbon atoms, a substituted or unsubstituted phenyl group, a substituted or unsubstituted styryl group, or a structural unit expressed by general formula (Rh1) or (Rh2) below, x and z each denote an integer in a range of 0 to 4, j and y each denote an integer in a range of 0 to 5, n denotes an integer of 1 or 2, q denotes an integer in a range of 0 to 2, and r denotes an integer of 0 or 1, (Rh1)

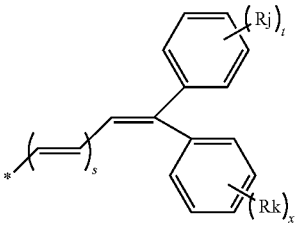

(Rh2)

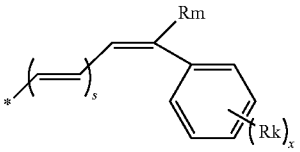

where, in the formulae (Rh1) and (Rh2), each of Rj, Rk, and Rm independently represents a hydrogen atom or an alkyl group having 1 to 3 carbon atoms, t denotes an integer in a range of 0 to 5, s denotes an integer of 0 or 1, and * denotes a binding site.

A high-quality electrophotographic photoconductor being capable of suppressing occurrence of filming while improving mechanical strength of the photosensitive layer by making the charge transport layer constituting the outermost surface layer of the photosensitive layer contain the specific hole transport material, resin binder, electron transport material, and inorganic oxide at a predetermined mass ratio and further being capable of maintaining high sensitivity and a high retention rate even in long-term printing by using a charge generation material having a specific heat characteristic as the charge generation layer can be provided.

The electron transport material preferably contains any one of compounds expressed by structural formulae (E-1) to (E-5) below and may contain a plurality of the compounds:

(E-1)

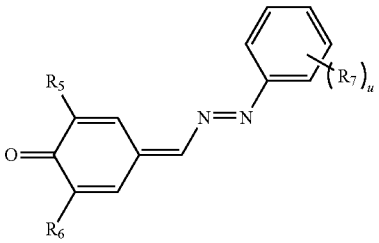

(E-2)

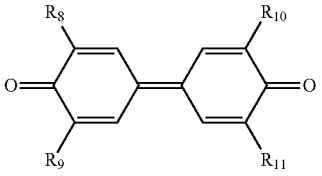

(E-3)

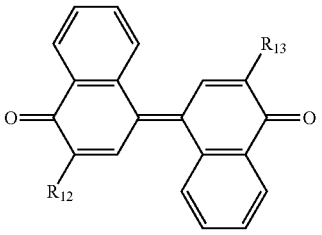

-continued (E-4)

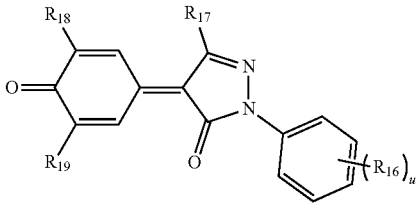

(E-5)

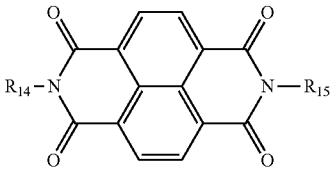

where, in the formulae (E-1), (E-2), (E-3), and (E-4), each of $R_5$, $R_6$, $R_7$, $R_8$, $R_9$, $R_{10}$, $R_{11}$, $R_{12}$, $R_{13}$, $R_{16}$, $R_{17}$, $R_{18}$, and $R_{19}$ independently represents a hydrogen atom, a halogen atom, a nitro group, a cyano group, an alkyl group having 1 to 6 carbon atoms that may have a substituent, an alkenyl group having 2 to 6 carbon atoms that may have a substituent, an alkoxy group having 1 to 6 carbon atoms that may have a substituent, an aryl group having 6 to 14 carbon atoms that may have a substituent, or a cycloalkyl group having 3 to 8 carbon atoms that may have a substituent, and u denotes an integer in a range of 0 to 5;

where, in the formula (E-5), each of $R_{14}$ and $R_{15}$ independently represents an aryl group having 6 to 14 carbon atoms that may have at least one alkyl group having 1 to 6 carbon atoms, an aryl group having 6 to 14 carbon atoms that may have a phenylcarbonyl group, an aralkyl group having 7 to 20 carbon atoms, an alkoxy group having 1 to 6 carbon atoms, an alkyl group having 1 to 8 carbon atoms that may have an alkylamino group, or a cycloalkyl group having 3 to 10 carbon atoms; and a selected group may be substituted by one or more halogen atoms.

Further, the resin binder preferably contains a resin having a viscosity-equivalent molecular weight equal to or greater than 15,000 and having a repeating unit expressed by structural formula (BD-1) below:

(BD-1)

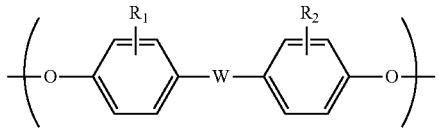

where each of $R_1$ and $R_2$ represents a hydrogen atom or an alkyl group having 1 to 3 carbon atoms, W represents a single bond, an oxygen atom, a sulfur atom, or $CR_3R_4$ where $R_3$ and $R^4$ may each independently represent a hydrogen atom or an alkyl group having 1 to 3 carbon atoms or may be bonded to each other to form a substituted or unsubstituted cycloalkyl group having 5 to 6 carbon atoms.

Furthermore, it is preferable that the inorganic oxide contain silica as a main component and aluminum in an amount equal to or greater than 1 ppm and equal to or less than 2000 ppm, and be subjected to surface treatment with a silane coupling agent having a structure expressed by a general formula (1) below:

$$(R^{21})_n—Si—(OR^{22})_{4-n} \quad (1),$$

where Si represents a silicon atom, $R^{21}$ represents an organic group formed by directly bonding carbon to the silicon atom, $R^{22}$ represents an organic group, and n denotes an integer in a range of 0 to 3.

In this case, the silane coupling agent preferably contains a material selected from the group consisting of phenyltrimethoxysilane, vinyltrimethoxysilane, epoxytrimethoxysilane, methacryltrimethoxysilane, aminotrimethoxysilane, ureidotrimethoxysilane, mercaptopropyltrimethoxysilane, isocyanatepropyltrimethoxysilane, phenylaminotrimethoxysilane, acryltrimethoxysilane, p-styryltrimethoxysilane, 3-acryloxypropyltrimethoxysilane, 3-methacryloxypropyltrimethoxysilane, 3-isocyanatepropyltrimethoxysilane, 3-aminopropyltrimethoxysilane, N-phenyl-3-aminopropyltrimethoxysilane, and combinations thereof.

Furthermore, it is preferable that the inorganic oxide be subjected to surface treatment with a plurality of types of the silane coupling agents, and a silane coupling agent first used in the surface treatment have a structure expressed by the general formula (1).

A second aspect of the present invention is a method of manufacturing the electrophotographic photoconductor, wherein the method includes: providing a charge generation layer coating liquid including the charge generation material; dip coating the electroconductive substrate in the charge generation layer coating liquid to form the charge generation layer; providing a charge transport layer coating liquid including the hole transport material, the resin binder, the electron transport material, and the inorganic oxide; and dip coating the substrate in the charge transport layer coating liquid to form the charge transport layer. The method may further include drying the charge generation layer coating liquid after dip coating thereof onto the substrate to provide a dried coated substrate, before dip coating the charge transport layer coating liquid onto the dried coated substrate.

A third aspect of the present invention is an electrophotographic device equipped with the electrophotographic photoconductor.

Effects of the Invention

It is obvious that by employing a photosensitive layer satisfying the aforementioned conditions, the present invention provides a high-quality electrophotographic photoconductor capable of improving mechanical strength of the photosensitive layer, maintaining high sensitivity and a high retention rate in long-term printing, and eliminating occurrence of filming.

The reason is considered to be as follows. The present invention improves mechanical strength of the photosensitive layer by making the charge transport layer constituting the outermost surface layer of the photosensitive layer contain a resin binder and an inorganic oxide having specific structures. However, when a certain amount or more of inorganic oxide is added to the photosensitive layer, aggregates of inorganic oxide increase that may cause a decrease in sensitivity due to a decrease in film transmittance, a microscopic defect on an image, and a filming phenomenon of a toner component adhering to the photosensitive layer caused by the aggregates of the inorganic oxide resulting in an image failure. Further, there is a risk that the addition of a certain amount or more of resin causes a decrease in sensitivity and a sufficient characteristic is not acquired.

On the other hand, by using a hole transport material with a specific structure exhibiting high mobility capable of increasing an amount of resin in the charge transport layer constituting the outermost surface layer of the photosensitive layer and by setting the compounded amount of each component in the charge transport layer to a predetermined ratio, the present invention can provide the effect of not causing filming while having abrasion resistance in long-term printing. Further, by making the photosensitive layer contain a charge generation material having a specific heat characteristic, an electrophotographic photoconductor having stable electric characteristics even after long-term printing compared with the initial stage can be provided. Furthermore, an amount of inorganic oxide in a certain range capable of imparting mechanical strength to the charge transport layer without increasing aggregates can be contained. In addition, by using a resin binder having a resin skeleton with a specific structure as the resin binder in the charge transport layer, higher durability can be achieved.

MODE FOR CARRYING OUT THE INVENTION

Specific embodiments of the electrophotographic photoconductor according to the present invention will be described in detail below with reference to the drawings. The present invention is not at all limited by the following description.

Figure 1:
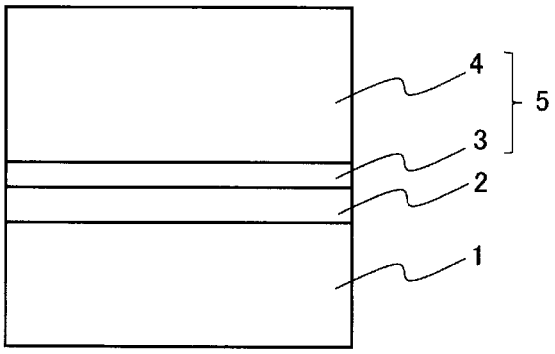
FIG. 1 is a schematic cross-sectional view illustrating an example of an electrophotographic photoconductor according to an embodiment of the present invention.

FIG. 1 is a schematic cross-sectional view illustrating an example of an electrophotographic photoconductor according to an embodiment of the present invention, illustrating a negatively-charged multilayer electrophotographic photoconductor.

As illustrated, an undercoating layer 2 and a photosensitive layer 5 including a charge generation layer 3 having the charge generation function and a charge transport layer 4 having the charge transport function are successively laminated on an electroconductive substrate 1 in the negatively-charged multilayer photoconductor. The undercoating layer 2 may be provided as needed.

The photoconductor according to the embodiment of the present invention includes the electroconductive substrate 1, the charge generation layer 3 containing a charge generation material, and the charge transport layer 4 containing a hole transport material, a resin binder, an electron transport material, and an inorganic oxide, the charge generation layer 3 and the charge transport layer 4 being provided on the electroconductive substrate 1.

The hole transport material contained in the charge transport layer 4 in the photoconductor according to the embodiment of the present invention contains a compound having a structure expressed by general formula (A-1) below. By using such a hole transport material, an effect of maintaining high sensitivity after long-term printing in the photosensitive layer can be acquired.

The structure expressed by general formula (A-1) is:

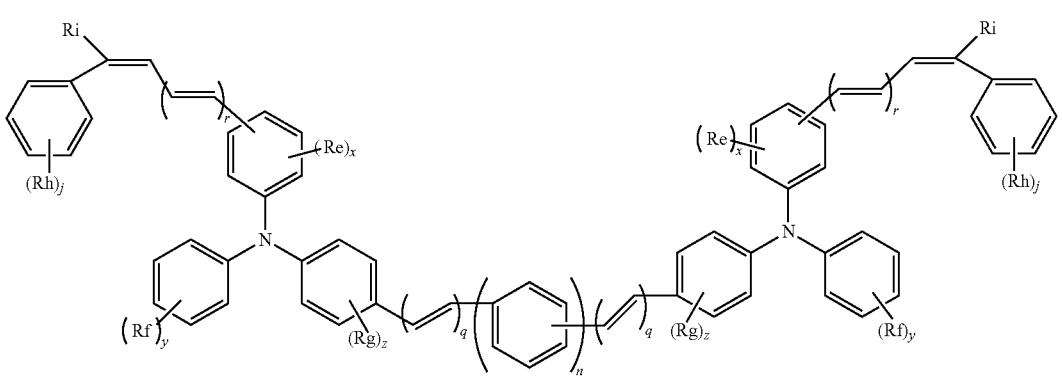

where, each of Re, Rf, Rg, and Ri independently represents a hydrogen atom, a branched or unbranched alkyl group having 1 to 6 carbon atoms, an alkoxy group having 1 to 3 carbon atoms, a substituted or unsubstituted phenyl group, or a substituted or unsubstituted styryl group, Rh represents a hydrogen atom, a branched or unbranched alkyl group having 1 to 6 carbon atoms, an alkoxy group having 1 to 3 carbon atoms, a substituted or unsubstituted phenyl group, a substituted or unsubstituted styryl group, or a structural unit expressed by general formula (Rh1) or (Rh2) below, x and z each denote an integer in a range of 0 to 4, j and y each denote an integer in a range of 0 to 5, n denotes an integer of 1 or 2, q denotes an integer in a range of 0 to 2, and r denotes an integer of 0 or 1, (Rh1)

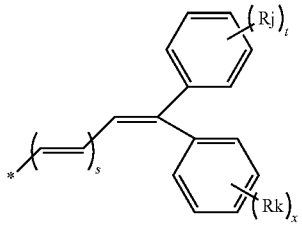

(Rh2)

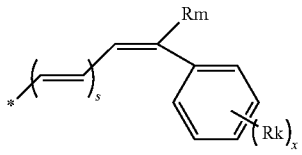

where, in the formulae (Rh1) and (Rh2), each of Rj, Rk, and Rm independently represents a hydrogen atom or an alkyl group having 1 to 3 carbon atoms, t denotes an integer in a range of 0 to 5, s denotes an integer of 0 or 1, and * denotes a binding site.

For example, hole transport materials shown in Tables 1 to 8 below may be suitably used as the hole transport material having the structure expressed by the general formula (A-1).

TABLE 1

| No. | Re | x | Position | Rf | y | Position | Rg | z | Position | q | n | Position | r | Rh | j | Position | Ri |
|---|---|---|---|---|---|---|---|---|---|---|---|---|---|---|---|---|---|
| HTM1-1 | — | 0 | — | Me | 2 | o-,p- | — | 0 | — | 1 | 1 | p- | 0 | Rh1 | 1 | p- | H |
| HTM1-2 | — | 0 | — | Me | 1 | p- | — | 0 | — | 1 | 1 | p- | 0 | Rh1 | 1 | p- | H |
| HTM1-3 | — | 0 | — | Me | 1 | m- | — | 0 | — | 1 | 1 | p- | 0 | Rh1 | 1 | p- | H |
| HTM1-4 | — | 0 | — | Me | 1 | o- | — | 0 | — | 1 | 1 | p- | 0 | Rh1 | 1 | p- | H |
| HTM1-5 | — | 0 | — | Et | 1 | p- | — | 0 | — | 1 | 1 | p- | 0 | Rh1 | 1 | p- | H |
| HTM1-6 | — | 0 | — | Et | 1 | m- | — | 0 | — | 1 | 1 | p- | 0 | Rh1 | 1 | p- | H |
| HTM1-7 | — | 0 | — | Et | 1 | o- | — | 0 | — | 1 | 1 | p- | 0 | Rh1 | 1 | p- | H |
| HTM1-8 | — | 0 | — | OMe | 1 | p- | — | 0 | — | 1 | 1 | p- | 0 | Rh1 | 1 | p- | H |
| HTM1-9 | — | 0 | — | OMe | 1 | m- | — | 0 | — | 1 | 1 | p- | 0 | Rh1 | 1 | p- | H |
| HTM1-10 | — | 0 | — | OMe | 1 | o- | — | 0 | — | 1 | 1 | p- | 0 | Rh1 | 1 | p- | H |
| HTM1-11 | — | 0 | — | OEt | 1 | p- | — | 0 | — | 1 | 1 | p- | 0 | Rh1 | 1 | p- | H |

TABLE 1-continued

| No. | Re | x | Position | Rf | y | Position | Rg | z | Position | q | n | Position | r | Rh | j | Position | Ri |
|---|---|---|---|---|---|---|---|---|---|---|---|---|---|---|---|---|---|
| HTM1-12 | — | 0 | — | — | — | — | — | 0 | — | 1 | 1 | p- | 0 | Rh1 | 1 | p- | H |
| HTM1-13 | — | 0 | — | — | — | — | Me | 1 | o- | 1 | 1 | p- | 0 | Rh1 | 1 | p- | H |
| HTM1-14 | — | 0 | — | Me | 2 | o-,p- | — | 0 | — | 1 | 1 | p- | 0 | Rh1 | 1 | p- | H |
| HTM1-15 | — | 0 | — | Me | 1 | p- | — | 0 | — | 1 | 1 | p- | 0 | Rh1 | 1 | p- | H |
| HTM1-16 | — | 0 | — | Me | 1 | m- | — | 0 | — | 1 | 1 | p- | 0 | Rh1 | 1 | p- | H |
| HTM1-17 | — | 0 | — | Me | 1 | o- | — | 0 | — | 1 | 1 | p- | 0 | Rh1 | 1 | p- | H |
| HTM1-18 | — | 0 | — | Et | 1 | o- | — | 0 | — | 1 | 1 | p- | 0 | Rh1 | 1 | p- | H |
| HTM1-19 | — | 0 | — | OMe | 1 | p- | — | 0 | — | 1 | 1 | p- | 0 | Rh1 | 1 | p- | H |
| HTM1-20 | — | 0 | — | OEt | 1 | p- | — | 0 | — | 1 | 1 | p- | 0 | Rh1 | 1 | p- | H |
| HTM1-21 | — | 0 | — | — | — | — | — | 0 | — | 1 | 1 | p- | 0 | Rh1 | 1 | p- | H |
| HTM1-22 | — | 0 | — | — | — | — | Me | 1 | o- | 1 | 1 | p- | 0 | Rh1 | 1 | p- | H |
| HTM1-23 | — | 0 | — | Me | 2 | o-,p- | — | 0 | — | 1 | 1 | m- | 0 | Rh1 | 1 | p- | H |
| HTM1-24 | — | 0 | — | Me | 2 | o-,p- | — | 0 | — | 1 | 1 | o- | 0 | Rh1 | 1 | p- | H |
| HTM1-25 | — | 0 | — | Me | 2 | o-,p- | — | 0 | — | 1 | 1 | p- | 0 | Rh2 | 1 | p- | H |
| HTM1-26 | — | 0 | — | Me | 1 | p- | — | 0 | — | 1 | 1 | p- | 0 | Rh2 | 1 | p- | H |

TABLE 2

| No. | Re | x | Position | Rf | y | Position | Rg | z | Position | q | n | Position | r | Rh | j | Position | Ri |
|---|---|---|---|---|---|---|---|---|---|---|---|---|---|---|---|---|---|
| HTM1-27 | — | 0 | — | Et | 1 | o- | — | 0 | — | 1 | 1 | p- | 0 | Rh2 | 1 | p- | H |
| HTM1-28 | — | 0 | — | Me | 2 | o-,p- | — | 0 | — | 1 | 1 | p- | 0 | Rh2 | 1 | p- | H |
| HTM1-29 | — | 0 | — | Me | 1 | p- | — | 0 | — | 1 | 1 | p- | 0 | Rh2 | 1 | p- | H |
| HTM1-30 | — | 0 | — | Et | 1 | o- | — | 0 | — | 1 | 1 | p- | 0 | Rh2 | 1 | p- | H |
| HTM1-31 | Me | 1 | o- | Me | 2 | o-,p- | — | 0 | — | 1 | 1 | p- | 0 | Rh1 | 1 | p- | H |
| HTM1-32 | — | 0 | — | — | — | — | — | 0 | — | 1 | 2 | p-,p- | 0 | Rh1 | 1 | p- | H |
| HTM1-33 | — | 0 | — | Me | 2 | o-,p- | — | 0 | — | 1 | 2 | p-,p- | 0 | Rh1 | 1 | p- | H |
| HTM1-34 | — | 0 | — | Me | 1 | p- | — | 0 | — | 1 | 2 | p-,p- | 0 | Rh1 | 1 | p- | H |
| HTM1-35 | — | 0 | — | Me | 1 | m- | — | 0 | — | 1 | 2 | p-,p- | 0 | Rh1 | 1 | p- | H |
| HTM1-36 | — | 0 | — | Me | 1 | o- | — | 0 | — | 1 | 2 | p-,p- | 0 | Rh1 | 1 | p- | H |
| HTM1-37 | — | 0 | — | Et | 1 | p- | — | 0 | — | 1 | 2 | p-,p- | 0 | Rh1 | 1 | p- | H |
| HTM1-38 | — | 0 | — | Et | 1 | m- | — | 0 | — | 1 | 2 | p-,p- | 0 | Rh1 | 1 | p- | H |
| HTM1-39 | — | 0 | — | Et | 1 | o- | — | 0 | — | 1 | 2 | p-,p- | 0 | Rh1 | 1 | p- | H |
| HTM1-40 | — | 0 | — | OMe | 1 | p- | — | 0 | — | 1 | 2 | p-,p- | 0 | Rh1 | 1 | p- | H |
| HTM1-41 | — | 0 | — | OMe | 1 | m- | — | 0 | — | 1 | 2 | p-,p- | 0 | Rh1 | 1 | p- | H |
| HTM1-42 | — | 0 | — | OMe | 1 | o- | — | 0 | — | 1 | 2 | p-,p- | 0 | Rh1 | 1 | p- | H |
| HTM1-43 | — | 0 | — | OEt | 1 | p- | — | 0 | — | 1 | 2 | p-,p- | 0 | Rh1 | 1 | p- | H |
| HTM1-44 | — | 0 | — | Me | 2 | o-,p- | — | 0 | — | 1 | 2 | p-,p- | 0 | Rh1 | 1 | p- | H |
| HTM1-45 | — | 0 | — | Me | 1 | p- | — | 0 | — | 1 | 2 | p-,p- | 0 | Rh1 | 1 | p- | H |
| HTM1-46 | — | 0 | — | Me | 1 | m- | — | 0 | — | 1 | 2 | p-,p- | 0 | Rh1 | 1 | p- | H |
| HTM1-47 | — | 0 | — | Me | 1 | o- | — | 0 | — | 1 | 2 | p-,p- | 0 | Rh1 | 1 | p- | H |

TABLE 3

| No. | s | Rj | t | Position | Rk | t | Position | Rm |
|---|---|---|---|---|---|---|---|---|
| HTM1-1 | 1 | — | — | — | — | — | — | — |
| HTM1-2 | 1 | — | — | — | — | — | — | — |
| HTM1-3 | 1 | — | — | — | — | — | — | — |
| HTM1-4 | 1 | — | — | — | — | — | — | — |
| HTM1-5 | 1 | — | — | — | — | — | — | — |
| HTM1-6 | 1 | — | — | — | — | — | — | — |
| HTM1-7 | 1 | — | — | — | — | — | — | — |
| HTM1-8 | 1 | — | — | — | — | — | — | — |
| HTM1-9 | 1 | — | — | — | — | — | — | — |
| HTM1-10 | 1 | — | — | — | — | — | — | — |
| HTM1-11 | 1 | — | — | — | — | — | — | — |
| HTM1-12 | 1 | — | — | — | — | — | — | — |
| HTM1-13 | 1 | — | — | — | — | — | — | — |
| HTM1-14 | 1 | Me | 1 | p- | Me | 1 | p- | — |
| HTM1-15 | 1 | Me | 1 | p- | Me | 1 | p- | — |
| HTM1-16 | 1 | Me | 1 | p- | Me | 1 | p- | — |
| HTM1-17 | 1 | Me | 1 | p- | Me | 1 | p- | — |
| HTM1-18 | 1 | Me | 1 | p- | Me | 1 | p- | — |
| HTM1-19 | 1 | Me | 1 | p- | Me | 1 | p- | — |
| HTM1-20 | 1 | Me | 1 | p- | Me | 1 | p- | — |
| HTM1-21 | 1 | Me | 1 | p- | Me | 1 | p- | — |
| HTM1-22 | 1 | Me | 1 | p- | Me | 1 | p- | — |
| HTM1-23 | 1 | — | — | — | — | — | — | — |
| HTM1-24 | 1 | — | — | — | — | — | — | — |

TABLE 3-continued

| No. | s | Rj | t | Position | Rk | t | Position | Rm |
|---|---|---|---|---|---|---|---|---|
| HTM1-25 | 1 | — | — | — | — | — | — | H |
| HTM1-26 | 1 | — | — | — | — | — | — | H |

TABLE 4

| No. | s | Rj | t | Position | Rk | t | Position | Rm |
|---|---|---|---|---|---|---|---|---|
| HTM1-27 | 1 | — | — | — | — | — | — | H |
| HTM1-28 | 1 | — | — | — | Me | 1 | p- | |
| HTM1-29 | 1 | — | — | — | Me | 1 | p- | |
| HTM1-30 | 1 | — | — | — | Me | 1 | p- | |
| HTM1-31 | 1 | — | — | — | — | — | — | — |
| HTM1-32 | 1 | — | — | — | — | — | — | — |
| HTM1-33 | 1 | — | — | — | — | — | — | — |
| HTM1-34 | 1 | — | — | — | — | — | — | — |
| HTM1-35 | 1 | — | — | — | — | — | — | — |
| HTM1-36 | 1 | — | — | — | — | — | — | — |
| HTM1-37 | 1 | — | — | — | — | — | — | — |
| HTM1-38 | 1 | — | — | — | — | — | — | — |
| HTM1-39 | 1 | — | — | — | — | — | — | — |
| HTM1-40 | 1 | — | — | — | — | — | — | — |
| HTM1-41 | 1 | — | — | — | — | — | — | — |

TABLE 4-continued

| No. | s | Rj | t | Position | Rk | t | Position | Rm |
|---|---|---|---|---|---|---|---|---|
| HTM1-42 | 1 | — | — | — | — | — | — | — |
| HTM1-43 | 1 | — | — | — | — | — | — | — |
| HTM1-44 | 1 | Me | 1 | p- | Me | 1 | p- | — |
| HTM1-45 | 1 | Me | 1 | p- | Me | 1 | p- | — |
| HTM1-46 | 1 | Me | 1 | p- | Me | 1 | p- | — |
| HTM1-47 | 1 | Me | 1 | p- | Me | 1 | p- | — |

TABLE 5

| No. | Re | x | Position | Rf | y | Position | Rg | z | Position | q | n | Position | r | Rh | j | Position | Ri |
|---|---|---|---|---|---|---|---|---|---|---|---|---|---|---|---|---|---|
| HTM2-1 | — | 0 | — | Me | 2 | o-,p- | — | 0 | — | 1 | 1 | p- | 0 | — | — | — | ph |
| HTM2-2 | — | 0 | — | Me | 1 | o- | — | 0 | — | 1 | 1 | p- | 0 | — | — | — | ph |
| HTM2-3 | — | 0 | — | Me | 1 | m- | — | 0 | — | 1 | 1 | p- | 0 | — | — | — | ph |
| HTM2-4 | — | 0 | — | Me | 1 | p- | — | 0 | — | 1 | 1 | p- | 0 | — | — | — | ph |
| HTM2-5 | — | 0 | — | Et | 1 | o- | — | 0 | — | 1 | 1 | p- | 0 | — | — | — | ph |
| HTM2-6 | — | 0 | — | Et | 1 | m- | — | 0 | — | 1 | 1 | p- | 0 | — | — | — | ph |
| HTM2-7 | — | 0 | — | Et | 1 | p- | — | 0 | — | 1 | 1 | p- | 0 | — | — | — | ph |
| HTM2-8 | Me | 1 | o- | Me | 2 | o-,p- | — | 0 | — | 1 | 1 | p- | 0 | — | — | — | ph |
| HTM2-9 | Me | 1 | o- | Me | 1 | o- | — | 0 | — | 1 | 1 | p- | 0 | — | — | — | ph |
| HTM2-10 | Me | 1 | o- | Me | 1 | p- | — | 0 | — | 1 | 1 | p- | 0 | — | — | — | ph |
| HTM2-11 | — | 0 | — | Me | 2 | o-,p- | Me | 1 | o- | 1 | 1 | p- | 0 | — | — | — | ph |
| HTM2-12 | — | 0 | — | Me | 1 | o- | Me | 1 | o- | 1 | 1 | p- | 0 | — | — | — | ph |
| HTM2-13 | — | 0 | — | Me | 1 | p- | Me | 1 | o- | 1 | 1 | p- | 0 | — | — | — | ph |
| HTM2-14 | — | 0 | — | — | — | — | — | 0 | — | 1 | 1 | p- | 0 | — | — | — | ph |
| HTM2-15 | — | 0 | — | Me | 2 | o-,p- | — | 0 | — | 1 | 1 | p- | 0 | Me | 1 | p- | -p-tolyl |
| HTM2-16 | — | 0 | — | Me | 1 | o- | — | 0 | — | 1 | 1 | p- | 0 | Me | 1 | p- | -p-tolyl |
| HTM2-17 | — | 0 | — | Me | 1 | m- | — | 0 | — | 1 | 1 | p- | 0 | Me | 1 | p- | -p-tolyl |
| HTM2-18 | — | 0 | — | Me | 1 | p- | — | 0 | — | 1 | 1 | p- | 0 | Me | 1 | p- | -p-tolyl |
| HTM2-19 | — | 0 | — | Et | 1 | o- | — | 0 | — | 1 | 1 | p- | 0 | Me | 1 | p- | -p-tolyl |
| HTM2-20 | — | 0 | — | Et | 1 | m- | — | 0 | — | 1 | 1 | p- | 0 | Me | 1 | p- | -p-tolyl |
| HTM2-21 | — | 0 | — | Et | 1 | p- | — | 0 | — | 1 | 1 | p- | 0 | Me | 1 | p- | -p-tolyl |
| HTM2-22 | Me | 1 | o- | Me | 2 | o-,p- | — | 0 | — | 1 | 1 | p- | 0 | Me | 1 | p- | -p-tolyl |
| HTM2-23 | Me | 1 | o- | Me | 1 | o- | — | 0 | — | 1 | 1 | p- | 0 | Me | 1 | p- | -p-tolyl |
| HTM2-24 | Me | 1 | o- | Me | 1 | p- | — | 0 | — | 1 | 1 | p- | 0 | Me | 1 | p- | -p-tolyl |
| HTM2-25 | — | 0 | — | — | — | — | — | 0 | — | 1 | 1 | p- | 0 | Me | 1 | p- | -p-tolyl |
| HTM2-26 | — | 0 | — | Me | 2 | o-,p- | — | 0 | — | 1 | 1 | p- | 0 | Me | 1 | m- | -m-tolyl |

TABLE 6

| No. | Re | x | Position | Rf | y | Position | Rg | z | Position | q | n | Position | r | Rh | j | Position | Ri |
|---|---|---|---|---|---|---|---|---|---|---|---|---|---|---|---|---|---|
| HTM2-27 | — | 0 | — | Me | 1 | o- | — | 0 | — | 1 | 1 | p- | 0 | Me | 1 | m- | -m-tolyl |
| HTM2-28 | — | 0 | — | Me | 1 | m- | — | 0 | — | 1 | 1 | p- | 0 | Me | 1 | m- | -m-tolyl |
| HTM2-29 | — | 0 | — | Me | 1 | p- | — | 0 | — | 1 | 1 | p- | 0 | Me | 1 | m- | -m-tolyl |
| HTM2-30 | — | 0 | — | Et | 1 | o- | — | 0 | — | 1 | 1 | p- | 0 | Me | 1 | m- | -m-tolyl |
| HTM2-31 | — | 0 | — | Et | 1 | m- | — | 0 | — | 1 | 1 | p- | 0 | Me | 1 | m- | -m-tolyl |
| HTM2-32 | — | 0 | — | Et | 1 | p- | — | 0 | — | 1 | 1 | p- | 0 | Me | 1 | m- | -m-tolyl |
| HTM2-33 | Me | 1 | o- | Me | 2 | o-,p- | — | 0 | — | 1 | 1 | p- | 0 | Me | 1 | m- | -m-tolyl |
| HTM2-34 | Me | 1 | o- | Me | 1 | o- | — | 0 | — | 1 | 1 | p- | 0 | Me | 1 | m- | -m-tolyl |
| HTM2-35 | Me | 1 | o- | Me | 1 | p- | — | 0 | — | 1 | 1 | p- | 0 | Me | 1 | m- | -m-tolyl |
| HTM2-36 | — | 0 | — | — | — | — | — | 0 | — | 1 | 1 | p- | 0 | Me | 1 | m- | -m-tolyl |
| HTM2-37 | — | 0 | — | Me | 2 | o-,p- | — | 0 | — | 1 | 1 | p- | 0 | — | — | — | H |
| HTM2-38 | — | 0 | — | Me | 1 | o- | — | 0 | — | 1 | 1 | p- | 0 | — | — | — | H |
| HTM2-39 | — | 0 | — | Me | 1 | m- | — | 0 | — | 1 | 1 | p- | 0 | — | — | — | H |
| HTM2-40 | — | 0 | — | Me | 1 | p- | — | 0 | — | 1 | 1 | p- | 0 | — | — | — | H |
| HTM2-41 | — | 0 | — | Et | 1 | o- | — | 0 | — | 1 | 1 | p- | 0 | — | — | — | H |
| HTM2-42 | — | 0 | — | Et | 1 | m- | — | 0 | — | 1 | 1 | p- | 0 | — | — | — | H |
| HTM2-43 | — | 0 | — | Et | 1 | p- | — | 0 | — | 1 | 1 | p- | 0 | — | — | — | H |
| HTM2-44 | Me | 1 | o- | Me | 2 | o-,p- | — | 0 | — | 1 | 1 | p- | 0 | — | — | — | H |
| HTM2-45 | Me | 1 | o- | Me | 1 | o- | — | 0 | — | 1 | 1 | p- | 0 | — | — | — | H |
| HTM2-46 | Me | 1 | o- | Me | 1 | p- | — | 0 | — | 1 | 1 | p- | 0 | — | — | — | H |
| HTM2-47 | — | 0 | — | Me | 2 | o-,p- | Me | 1 | o- | 1 | 1 | p- | 0 | — | — | — | H |
| HTM2-48 | — | 0 | — | Me | 1 | o- | Me | 1 | o- | 1 | 1 | p- | 0 | — | — | — | H |
| HTM2-49 | — | 0 | — | Me | 1 | p- | Me | 1 | o- | 1 | 1 | p- | 0 | — | — | — | H |
| HTM2-50 | — | 0 | — | — | — | — | — | 0 | — | 1 | 1 | p- | 0 | — | — | — | H |

TABLE 7

| No. | Re | x | Position | Rf | y | Position | Rg | z | Position | q | n | Position | r | Rh | j | Position | Ri |
|---|---|---|---|---|---|---|---|---|---|---|---|---|---|---|---|---|---|
| HTM2-51 | — | 0 | — | Me | 2 | o-,p- | — | 0 | — | 1 | 1 | p- | 0 | Me | 1 | p- | H |
| HTM2-52 | — | 0 | — | Me | 1 | o- | — | 0 | — | 1 | 1 | p- | 0 | Me | 1 | p- | H |
| HTM2-53 | — | 0 | — | Me | 1 | m- | — | 0 | — | 1 | 1 | p- | 0 | Me | 1 | p- | H |
| HTM2-54 | — | 0 | — | Me | 1 | p- | — | 0 | — | 1 | 1 | p- | 0 | Me | 1 | p- | H |
| HTM2-55 | — | 0 | — | Et | 1 | o- | — | 0 | — | 1 | 1 | p- | 0 | Me | 1 | p- | H |
| HTM2-56 | — | 0 | — | Et | 1 | m- | — | 0 | — | 1 | 1 | p- | 0 | Me | 1 | p- | H |
| HTM2-57 | — | 0 | — | Et | 1 | p- | — | 0 | — | 1 | 1 | p- | 0 | Me | 1 | p- | H |
| HTM2-58 | Me | 1 | o- | Me | 2 | o-,p- | — | 0 | — | 1 | 1 | p- | 0 | Me | 1 | p- | H |
| HTM2-59 | Me | 1 | o- | Me | 1 | o- | — | 0 | — | 1 | 1 | p- | 0 | Me | 1 | p- | H |
| HTM2-60 | Me | 1 | o- | Me | 1 | p- | — | 0 | — | 1 | 1 | p- | 0 | Me | 1 | p- | H |
| HTM2-61 | — | 0 | — | — | — | — | — | 0 | — | 1 | 1 | p- | 0 | Me | 1 | p- | H |
| HTM2-62 | — | 0 | — | Me | 2 | o-,p- | — | 0 | — | 1 | 1 | p- | 0 | Me | 1 | m- | H |
| HTM2-63 | — | 0 | — | Me | 1 | o- | — | 0 | — | 1 | 1 | p- | 0 | Me | 1 | m- | H |
| HTM2-64 | — | 0 | — | Me | 1 | m- | — | 0 | — | 1 | 1 | p- | 0 | Me | 1 | m- | H |
| HTM2-65 | — | 0 | — | Me | 1 | p- | — | 0 | — | 1 | 1 | p- | 0 | Me | 1 | m- | H |
| HTM2-66 | — | 0 | — | Et | 1 | o- | — | 0 | — | 1 | 1 | p- | 0 | Me | 1 | m- | H |
| HTM2-67 | — | 0 | — | Et | 1 | m- | — | 0 | — | 1 | 1 | p- | 0 | Me | 1 | m- | H |
| HTM2-68 | — | 0 | — | Et | 1 | p- | — | 0 | — | 1 | 1 | p- | 0 | Me | 1 | m- | H |
| HTM2-69 | Me | 1 | o- | Me | 2 | o-,p- | — | 0 | — | 1 | 1 | p- | 0 | Me | 1 | m- | H |
| HTM2-70 | Me | 1 | o- | Me | 1 | o- | — | 0 | — | 1 | 1 | p- | 0 | Me | 1 | m- | H |
| HTM2-71 | Me | 1 | o- | Me | 1 | p- | — | 0 | — | 1 | 1 | p- | 0 | Me | 1 | m- | H |
| HTM2-72 | — | 0 | — | — | — | — | — | 0 | — | 1 | 1 | p- | 0 | Me | 1 | m- | H |
| HTM2-73 | — | 0 | — | Me | 2 | o-,p- | — | 0 | — | 1 | 2 | p-,p- | 0 | — | — | — | ph |
| HTM2-74 | — | 0 | — | Me | 1 | o- | — | 0 | — | 1 | 2 | p-,p- | 0 | — | — | — | ph |
| HTM2-75 | — | 0 | — | Me | 1 | m- | — | 0 | — | 1 | 2 | p-,p- | 0 | — | — | — | ph |
| HTM2-76 | — | 0 | — | Me | 1 | p- | — | 0 | — | 1 | 2 | p-,p- | 0 | — | — | — | ph |
| HTM2-77 | — | 0 | — | Et | 1 | o- | — | 0 | — | 1 | 2 | p-,p- | 0 | — | — | — | ph |

TABLE 8

| No. | Re | x | Position | Rf | y | Position | Rg | z | Position | q | n | Position | r | Rh | j | Position | Ri |
|---|---|---|---|---|---|---|---|---|---|---|---|---|---|---|---|---|---|
| HTM2-78 | — | 0 | — | Et | 1 | m- | — | 0 | — | 1 | 2 | p-,p- | 0 | — | — | — | ph |
| HTM2-79 | — | 0 | — | Et | 1 | p- | — | 0 | — | 1 | 2 | p-,p- | 0 | — | — | — | ph |
| HTM2-80 | Me | 1 | o- | Me | 2 | o-,p- | — | 0 | — | 1 | 2 | p-,p- | 0 | — | — | — | ph |
| HTM2-81 | Me | 1 | o- | Me | 1 | o- | — | 0 | — | 1 | 2 | p-,p- | 0 | — | — | — | ph |
| HTM2-82 | Me | 1 | o- | Me | 1 | p- | — | 0 | — | 1 | 2 | p-,p- | 0 | — | — | — | ph |
| HTM2-83 | — | 0 | — | Me | 2 | o-,p- | Me | 1 | o- | 1 | 2 | p-,p- | 0 | — | — | — | ph |
| HTM2-84 | — | 0 | — | Me | 1 | o- | Me | 1 | o- | 1 | 2 | p-,p- | 0 | — | — | — | ph |
| HTM2-85 | — | 0 | — | Me | 1 | p- | Me | 1 | o- | 1 | 2 | p-,p- | 0 | — | — | — | ph |
| HTM2-86 | — | 0 | — | — | — | — | — | 0 | — | 1 | 2 | p-,p- | 0 | — | — | — | ph |
| HTM2-87 | — | 0 | — | Me | 2 | o-,p- | — | 0 | — | 1 | 1 | p- | 1 | — | — | — | ph |
| HTM2-88 | — | 0 | — | Me | 1 | o- | — | 0 | — | 1 | 1 | p- | 1 | — | — | — | ph |
| HTM2-89 | — | 0 | — | Me | 1 | m- | — | 0 | — | 1 | 1 | p- | 1 | — | — | — | ph |
| HTM2-90 | — | 0 | — | Me | 1 | p- | — | 0 | — | 1 | 1 | p- | 1 | — | — | — | ph |
| HTM2-91 | — | 0 | — | Et | 1 | o- | — | 0 | — | 1 | 1 | p- | 1 | — | — | — | ph |
| HTM2-92 | — | 0 | — | Et | 1 | m- | — | 0 | — | 1 | 1 | p- | 1 | — | — | — | ph |
| HTM2-93 | — | 0 | — | Et | 1 | p- | — | 0 | — | 1 | 1 | p- | 1 | — | — | — | ph |
| HTM2-94 | Me | 1 | o- | Me | 2 | o-,p- | — | 0 | — | 1 | 1 | p- | 1 | — | — | — | ph |
| HTM2-95 | Me | 1 | o- | Me | 1 | o- | — | 0 | — | 1 | 1 | p- | 1 | — | — | — | ph |
| HTM2-96 | Me | 1 | o- | Me | 1 | p- | — | 0 | — | 1 | 1 | p- | 1 | — | — | — | ph |
| HTM2-97 | — | 0 | — | Me | 2 | o-,p- | Me | 1 | o- | 1 | 1 | p- | 1 | — | — | — | ph |
| HTM2-98 | — | 0 | — | Me | 1 | o- | Me | 1 | o- | 1 | 1 | p- | 1 | — | — | — | ph |
| HTM2-99 | — | 0 | — | Me | 1 | p- | Me | 1 | o- | 1 | 1 | p- | 1 | — | — | — | ph |
| HTM2-100 | — | 0 | — | — | — | — | — | 0 | — | 1 | 1 | p- | 1 | — | — | — | ph |
| HTM2-101 | — | 0 | — | Me | 2 | o-,p- | — | 0 | — | 1 | 1 | m- | 0 | — | — | — | ph |
| HTM2-102 | — | 0 | — | Me | 2 | o-,p- | — | 0 | — | 1 | 1 | m- | 0 | Me | 1 | p- | -ptolyl |
| HTM2-103 | — | 0 | — | Me | 2 | o-,p- | — | 0 | — | 1 | 1 | m- | 0 | — | — | — | H |
| HTM2-104 | — | 0 | — | Me | 2 | o-,p- | — | 0 | — | 1 | 1 | m- | 1 | — | — | — | ph |

Specific examples of a hole transport material having the structure expressed by the general formula (A-1) include the following.
HTM1-1
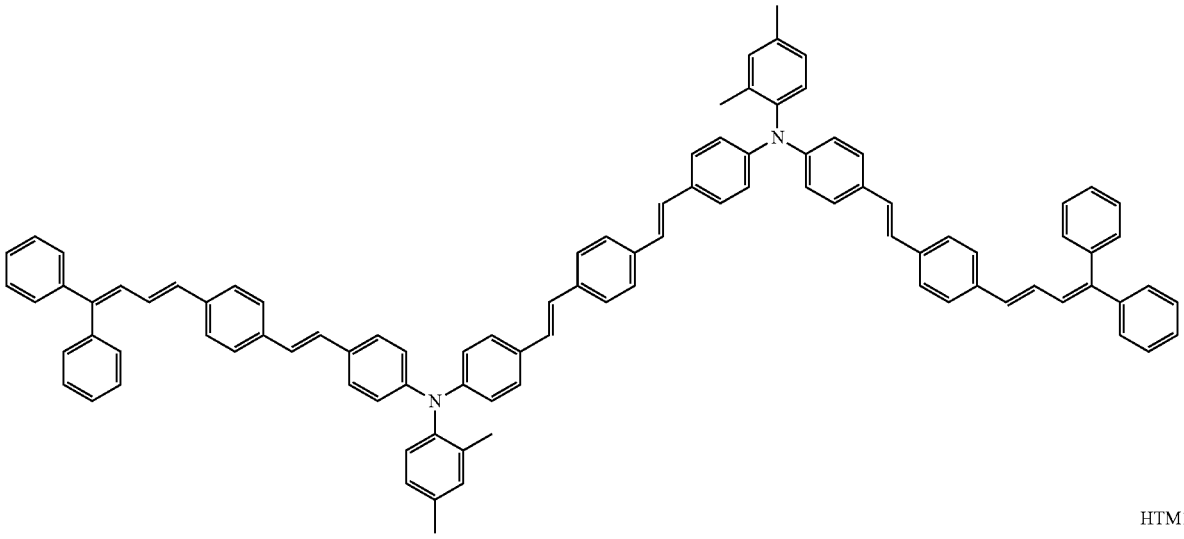
HTM1-5
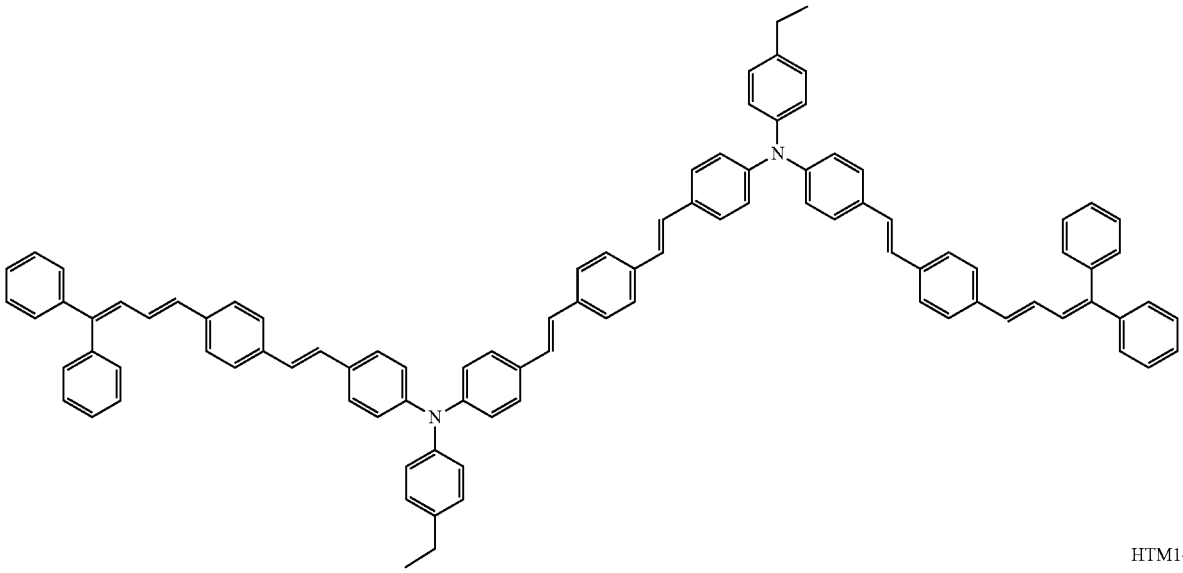
HTM1-12
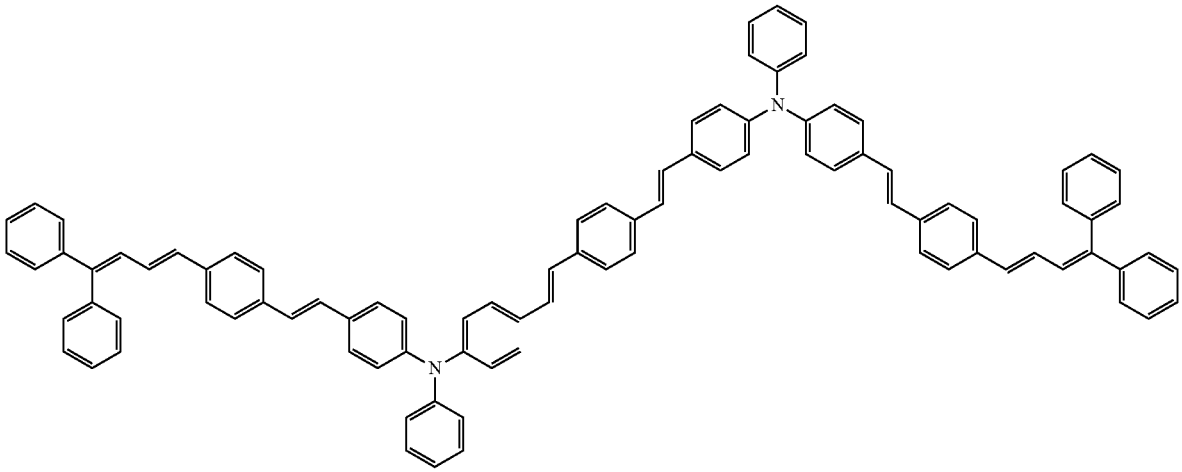

-continued
HTM1-14
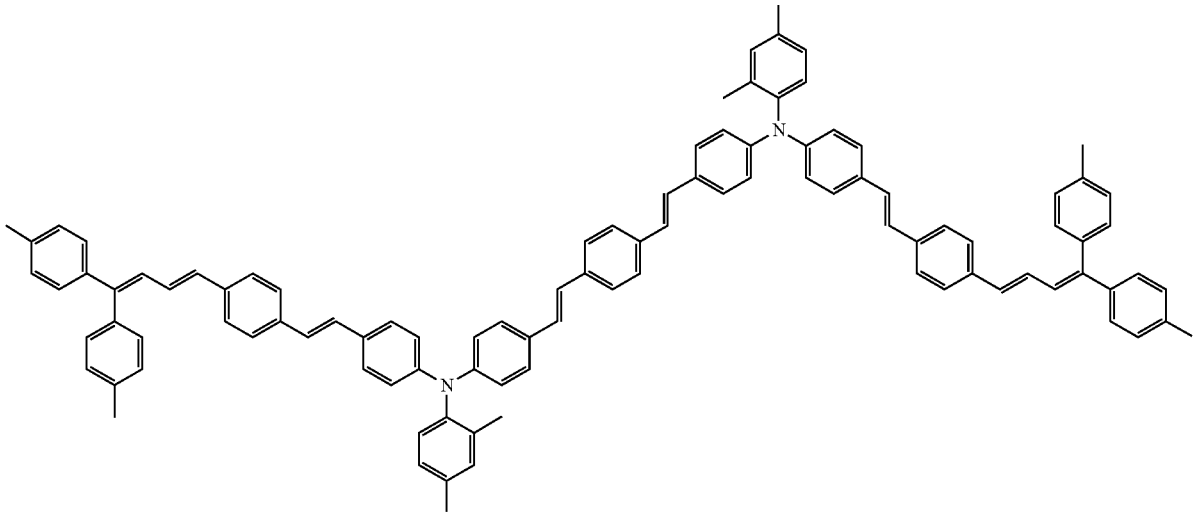
HTM1-23
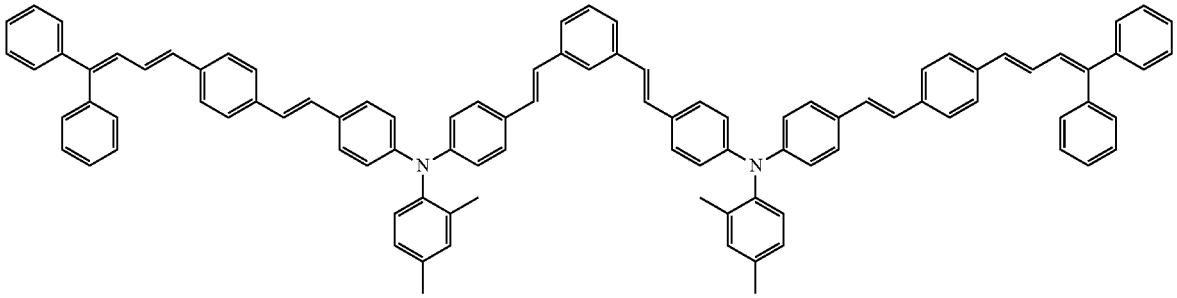
HTM1-33
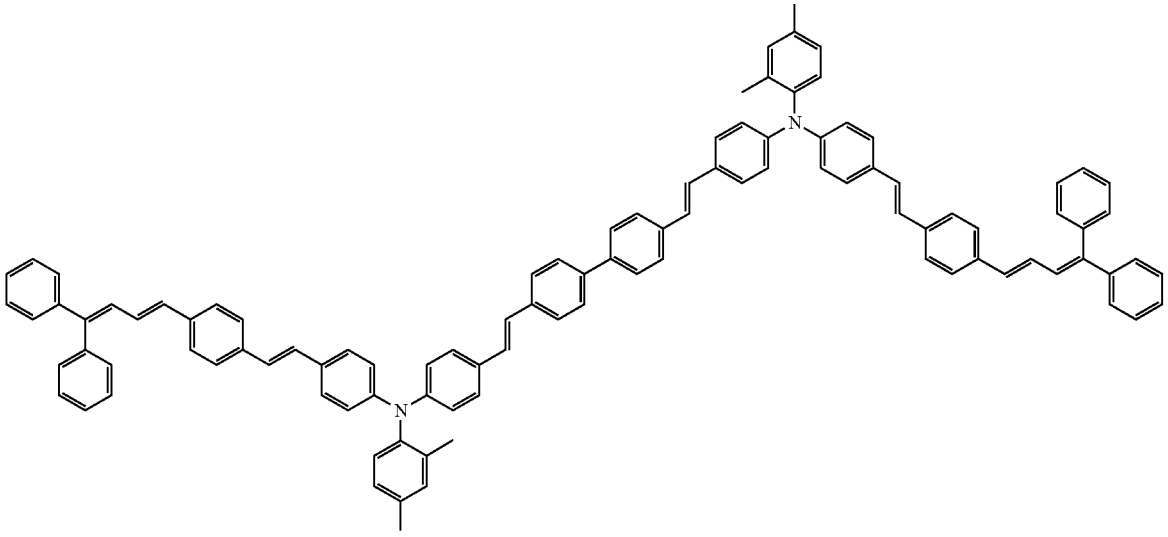

-continued
HTM2-1
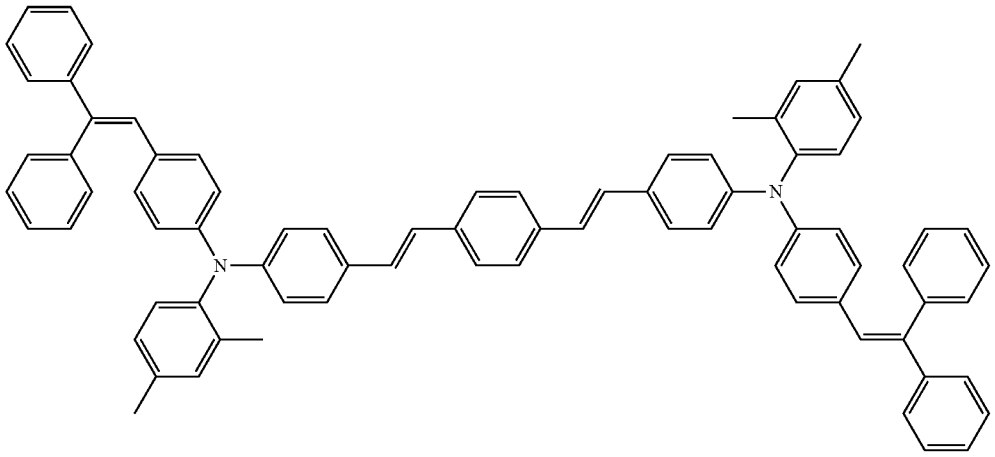
HTM2-8
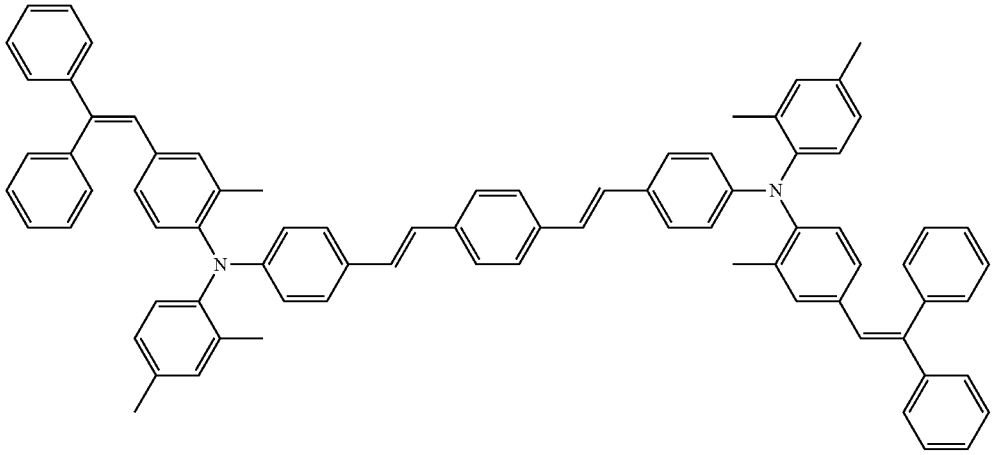
HTM2-15
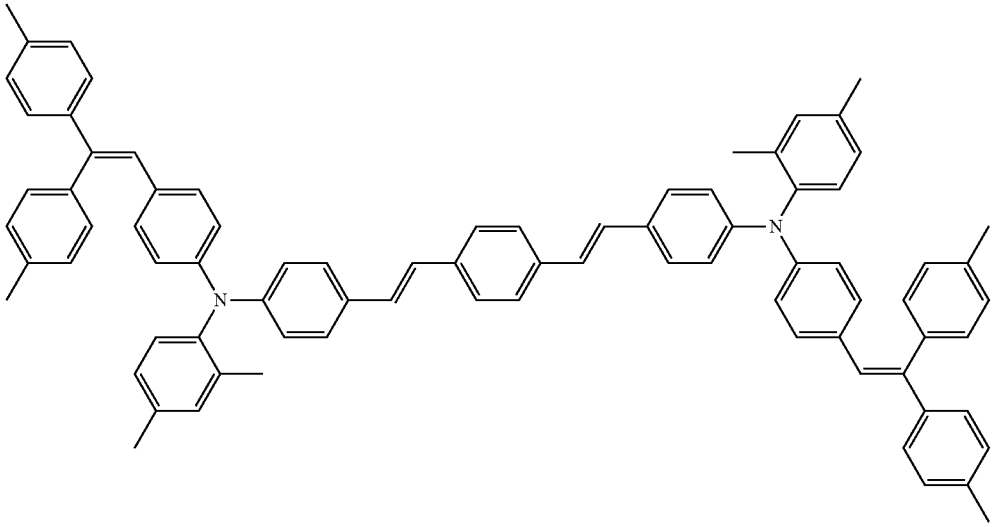

-continued
HTM2-36
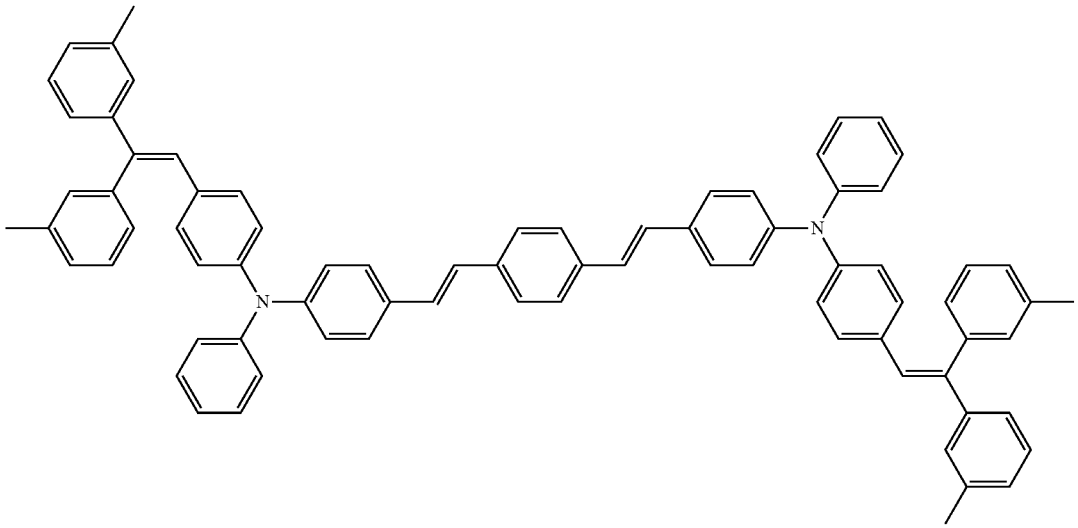
HTM2-62
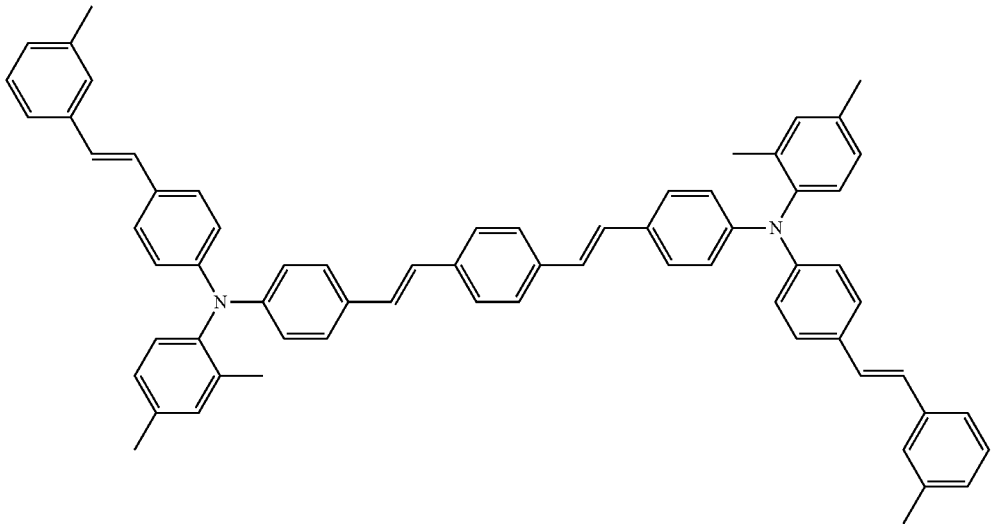
HTM2-73
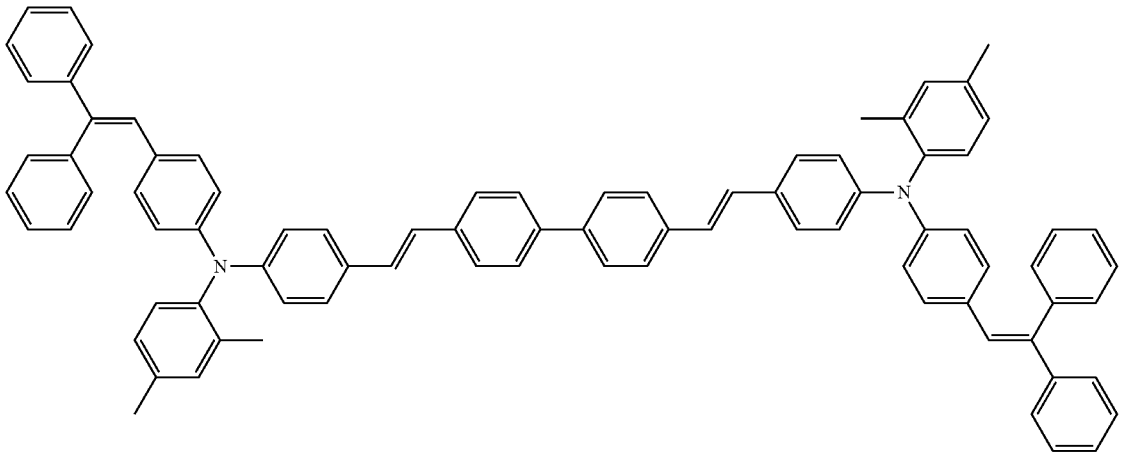

-continued

HTM2-87

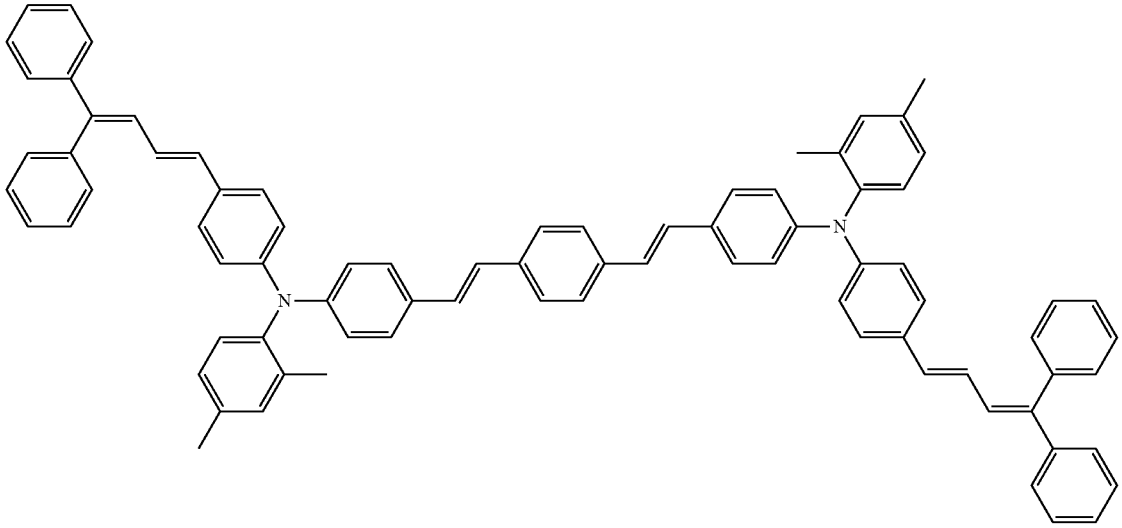

For example, compounds having these structures can be synthesized by a method described in WO2017/138566A1 or a method described in JP2000-066419A, but are not limited thereto.

While a site including a double bond in the aforementioned compounds may contain cis-trans geometrical isomers, the site may contain either one or a mixture of the two. A plurality of types of the aforementioned structures may be contained.

Further, in the photoconductor according to the embodiment of the present invention, a charge generation material contained in the charge generation layer 3 contains titanyl phthalocyanine having an exothermic peak at 251±5° C., a half-value width of the exothermic peak equal to or less than 15° C., and a heating value equal to or greater than 1.0 mJ/mg when a temperature rise condition is 20° C./min in differential scanning calorimetry (DSC) and having a diffraction peak at 27.2±0.3° in X-ray diffraction. In particular, the heating value is suitably equal to or greater than 1.0 mJ/mg and equal to or less than 10 mJ/mg. By using titanyl phthalocyanine having such a heat characteristic in combination with the structure of the photosensitive layer, an amount of decrease in a potential retention rate in long-term printing can be reduced. Further, since a large half-value width is considered to reflect a disturbance in a crystal structure, the phthalocyanine having a small half-value width is considered to have a small disturbance in the crystal structure and as a result can improve stability of electric characteristics.

As a method of manufacturing titanyl phthalocyanine having such characteristics, a synthesis method using phthalodinitrile and titanium alkoxide as raw materials, using an O-alkylisourea derivative as a base catalyst, and not using o-dichlorobenzene, chloronaphthalene, or quinoline as a synthetic solvent is particularly preferable. By such a manufacturing method, titanyl phthalocyanine having a distinctive heat characteristic resulting from a subtle difference in a crystal structure that can be confirmed by differential scanning calorimetry while indicating an X-ray diffraction structure called a Y-type is acquired; and effects of the present invention is considered to be acquired by using such titanyl phthalocyanine. Specific methods include a method described in JP2008-174677A, but are not limited thereto.

While there are descriptions about heat characteristics of titanyl phthalocyanine described in JPH04-221961A, JPH04-221962A, and JP2007-161992A, the descriptions are based on different exothermic peak temperatures, lack descriptions about a heating value and a peak shape, or are based on different starting materials, synthetic solvents and the like; and therefore such titanyl phthalocyanine does not provide the effects provided by the present invention.

For example, differential scanning calorimetry may be performed by use of DSC7020 manufactured by Hitachi High-Tech Science Corporation under a condition of a temperature rise speed of 20° C./min from 20 to 420° C. by use of a dedicated aluminum pan with a sample amount of 5 to 10 mg. A heating value can be calculated from an area of a heat generating part by taking a baseline of an exothermic peak, based on the acquired DSC curve.

At this time, a half-value width of the exothermic peak is more preferably equal to or less than 15° C. in terms of stability of electric characteristics. The half-value width can be calculated from temperature positions of two points where a heat flow rate value around the peak position is half the amount with respect to a height of the heat flow peak value from a baseline at the temperature indicating the exothermic peak.

Figure 10:
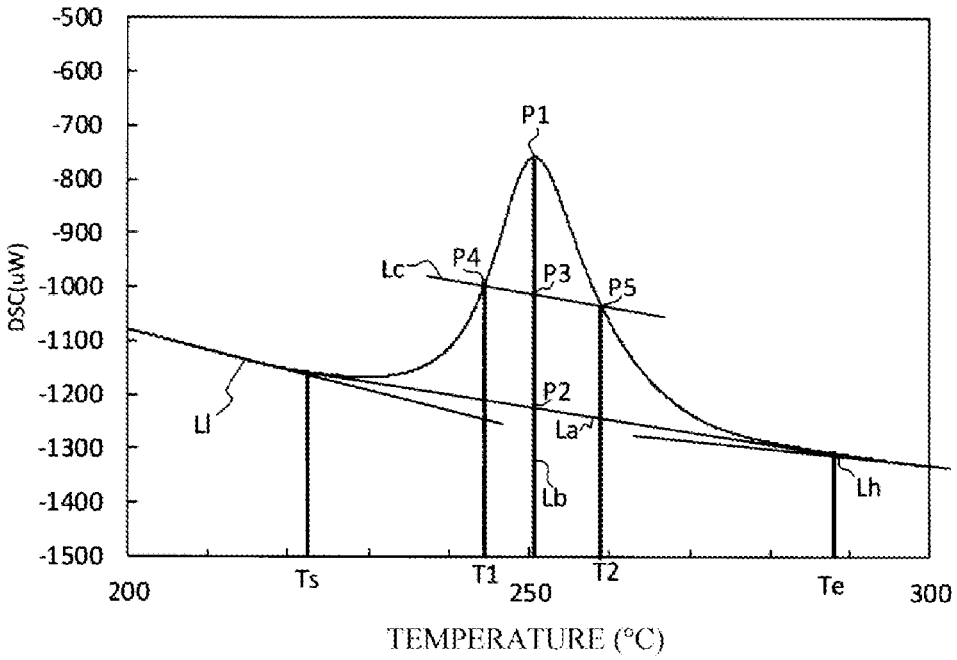
FIG. 10 is a graph illustrating a calculation method of a heating value and a half-value width in a DSC curve.

The temperature at a starting point of, the temperature at an end point of, and a half-value width of an exothermic peak in a DSC curve will be described with reference to FIG. 10.

In a DSC curve, the DSC curve in a temperature region where an exothermic peak is not observed is determined to be a baseline; and the temperature at a point where the DSC curve departs from a low-temperature-side baseline (Ll) is determined to be the temperature (Ts) at a starting point of an exothermic peak, and the temperature at a point where the DSC curve departs from a high-temperature-side baseline (Lh) is determined to be the temperature (Te) at an end point of the exothermic peak. An absolute value is calculated from an area value of a region enclosed by a straight line (La) connecting the point relating to the temperature (Ts) and the point relating to the temperature (Te) on the DSC curve, and the DSC curve; and the calculated absolute value is determined to be a heating value.

Further, a half-value width is defined as follows. In FIG. 10, an intersection (P2) of a perpendicular line (Lb) drawn from the vertex (P1) of the exothermic peak to the temperature axis and the straight line (La) is acquired, and a midpoint between the intersection (P2) and the vertex (P1) is denoted by (P3). A straight line (Lc) passing through the midpoint (P3) and being parallel with the straight line (La) is drawn, and denoting intersections of the straight line (Lc) and the DSC curve by a low-temperature-side intersection (P4) and a high-temperature-side intersection (P5), the temperature difference (T2−T1) between the temperature (T1) at the intersection (P4) and the temperature (T2) at the intersection (P5) is determined to be a half-value width.

Furthermore, the mass of each of the hole transport material, the resin binder, the electron transport material, and the inorganic oxide that are contained in the charge transport layer 4 in the photoconductor according to the embodiment of the present invention satisfies relations expressed by the following equations 1 to 5. Specifically, denoting the mass of the hole transport material by a, the mass of the resin binder by b, the mass of the electron transport material by c, and the mass of the inorganic oxide by d, a, b, c, and d satisfy conditions expressed by the following equations 1 to 5:

$$1.5 \leq b/a \leq 5.7, \quad \text{equation 1}$$

$$0.005 \leq c/a \leq 0.35, \quad \text{equation 2}$$

$$0.05 \leq d/a \leq 0.70, \quad \text{equation 3}$$

$$a \geq c+d, \text{ and} \quad \text{equation 4}$$

$$c/d \geq 0.01, \quad \text{equation 5}$$

In the equation 1, when b/a is less than 1.5, there is a risk that abrasion resistance in long-term printing is insufficient, and when b/a exceeds 5.7, a bright part potential rise in long-term printing increases.

In the equation 2, when c/a is less than 0.005, there is a risk that a ghost on an image worsens, and when c/a exceeds 0.35, there is a risk that charging stability deteriorates.

In the equation 3, when d/a is less than 0.05, there is a risk that abrasion resistance is insufficient in long-term printing, and when d/a exceeds 0.70, filming in long-term printing worsens.

In a range in which the equation 4 or the equation 5 does not hold, there is a risk that stability of electric characteristics in long-term use is not sufficiently acquired.

The present invention is not particularly limited to aspects other than the aforementioned structures and may be appropriately formed in accordance with a usual method.

(Electroconductive Substrate)

The electroconductive substrate 1 plays a role as an electrode of the photoconductor, at the same time, is a support for each layer constituting the photoconductor, and may have any shape such as cylindrical, plate-like, or film-like. Examples of a material of the electroconductive substrate 1 that may be used include metals such as aluminum, stainless steel, and nickel, and glass, a resin, or the like whose surfaces are subjected to conductive treatment.

(Undercoating Layer)

The undercoating layer 2 is made of a layer mainly containing a resin or a metal oxide film such as anodized aluminum. Such an undercoating layer 2 is provided as needed for the purpose of controlling charge injectability from the electroconductive substrate 1 to the photosensitive layer, covering a defect on the surface of the electroconductive substrate 1, improving adhesiveness between the photosensitive layer and the electroconductive substrate 1, and the like. Examples of a resin material to be used in the undercoating layer 2 include insulating polymers such as casein, polyvinyl alcohol, polyamide, melamine, and cellulose, and electroconductive polymers such as polythiophene, polypyrrole, and polyaniline, and the resins may be used singly or in combination as appropriate. Further, the resins may contain a metal oxide such as titanium dioxide or zinc oxide when used.

(Charge Generation Layer)

The charge generation layer 3 contains a charge generation material satisfying the aforementioned conditions, is formed by a method such as applying a coating liquid in which particles of the charge generation material are dispersed in a resin binder, and receives light and generates charges. High charge generation efficiency and injectability of generated charges into the charge transport layer 4 at the same time are important in the charge generation layer 3, and it is desirable that electric field dependence be low and excellent injection be provided even in a low electric field.

Titanyl phthalocyanine satisfying the aforementioned conditions is used as a charge generation material. In addition, phthalocyanine compounds such as X-type metal-free phthalocyanine, τ-type metal-free phthalocyanine, α-type titanyl phthalocyanine, β-type titanyl phthalocyanine, Y-type titanyl phthalocyanine having a heat characteristic different from that of the present invention, γ-type titanyl phthalocyanine, amorphous-type titanyl phthalocyanine, and ε-type copper phthalocyanine, and various types of azo pigments, anthanthrone pigments, thiapyrylium pigments, perylene pigments, perinone pigments, squarylium pigments, and quinacridone pigments may be used in combination as appropriate as a charge generation material, and a suitable substance can be selected according to a light wavelength region of an exposure light source used in image formation. In particular, a phthalocyanine compound can be suitably used. A charge generation material as a main constituent added with a hole transport material, an electron transport material, and the like may also be used as the charge generation layer 3.

Examples of the resin binder in the charge generation layer 3 that may be used in combination as appropriate include polycarbonate resin, polyester resin, polyamide resin, polyurethane resin, vinyl chloride resin, vinyl acetate resin, phenoxy resin, polyvinyl acetal resin, polyvinyl butyral resin, polystyrene resin, polysulfone resin, diallyl phthalate resin, and methacrylate resin polymers and copolymers thereof.

The content of a charge generation material in the charge generation layer 3 is suitably 20 to 80% by mass and is more suitably 30 to 70% by mass relative to the solid content in the charge generation layer 3. Further, the content of a resin binder in the charge generation layer 3 is suitably 20 to 80% by mass and is more suitably 30 to 70% by mass relative to the solid content in the charge generation layer 3.

Since the charge generation layer 3 has only to have the charge generation function, the film thickness thereof is generally 1 μm or less and is suitably 0.5 μm or less.

(Charge Transport Layer)

The charge transport layer 4 contains the hole transport material, resin binder, electron transport material and inorganic oxide.

As the hole transport material, another hole transport material may be used with a hole transport material having the structure expressed by the general formula (A-1). As such another hole transport material, a hole transport material including an arylamine structure other than the hole transport material having the structure expressed by the general formula (A-1) may be suitably used.

More specifically, an arylamine compound expressed by one of the following structural formulae (II-1) to (II-31) is preferably used as the another hole transport material but without being limited to the above, a material exhibiting hole transportability may be used.

II-1

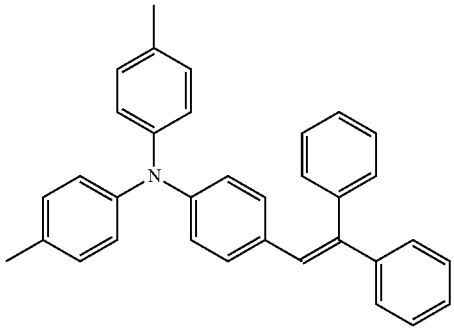

II-2

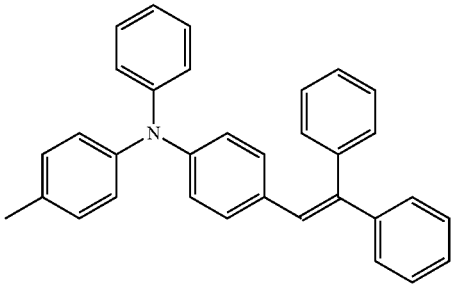

II-3

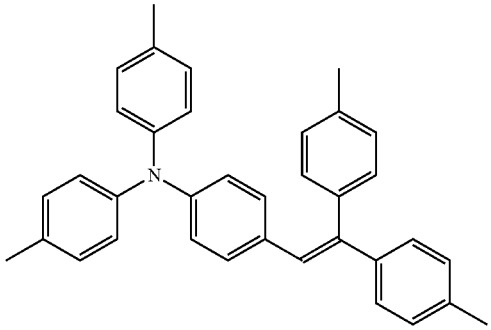

II-4

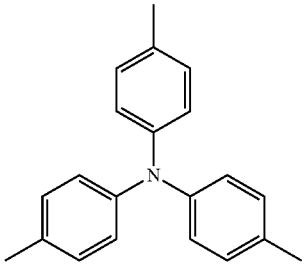

II-5

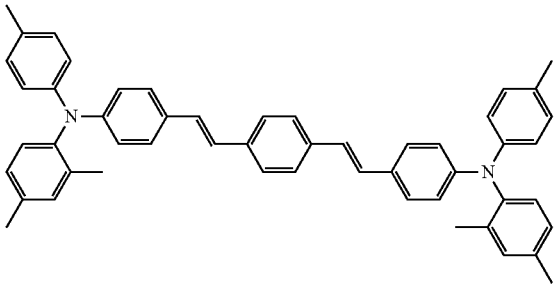

II-6

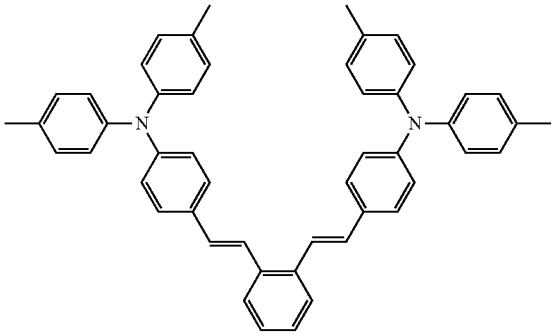

II-7

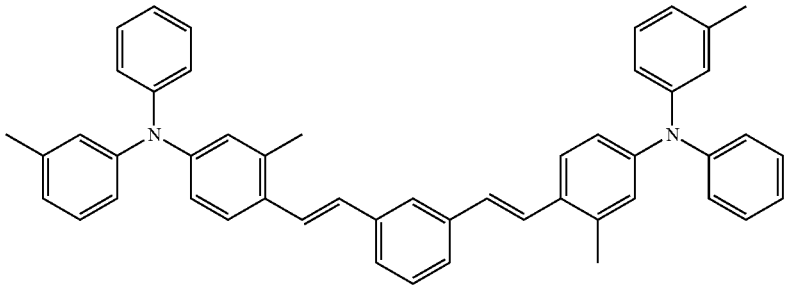

-continued
II-8
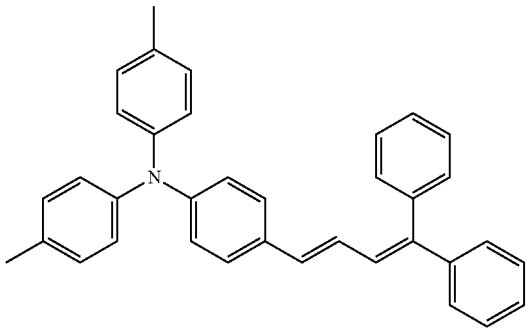
II-9
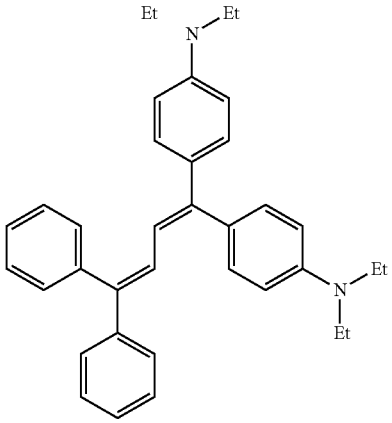
II-10
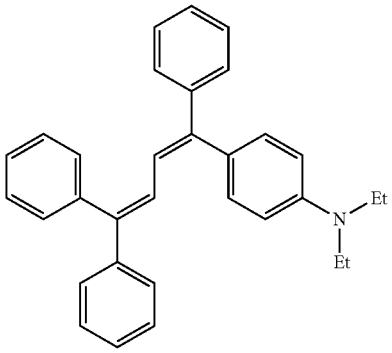
II-11
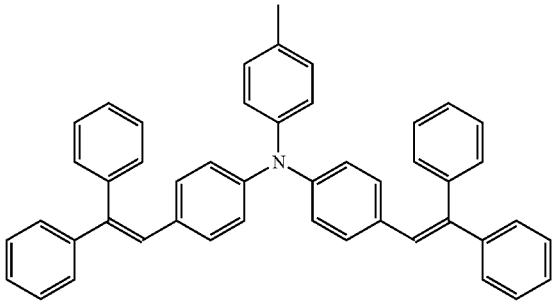
II-12
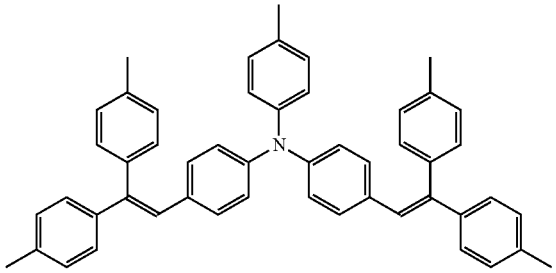
II-13
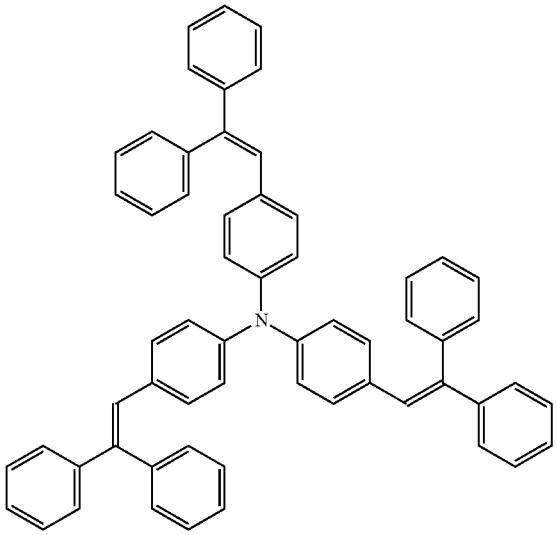

-continued
II-14
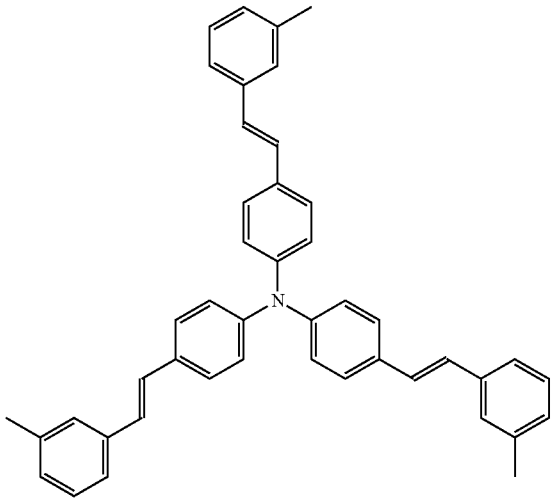
II-15
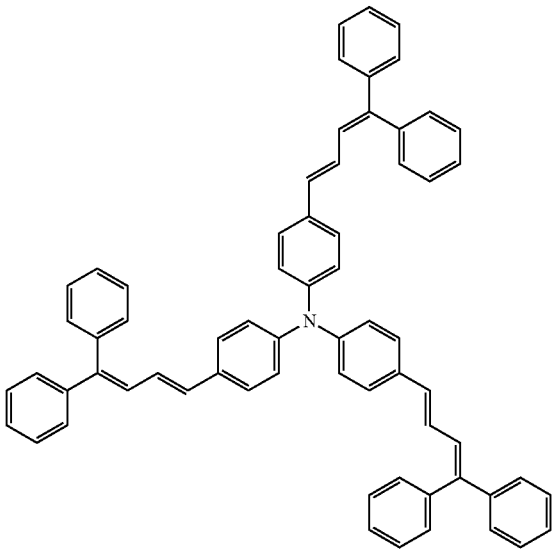
II-16
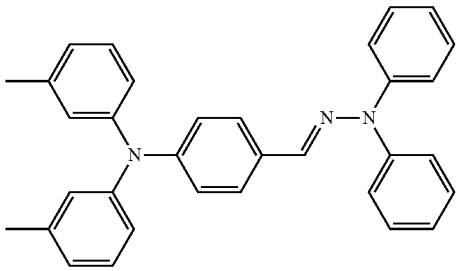
II-17
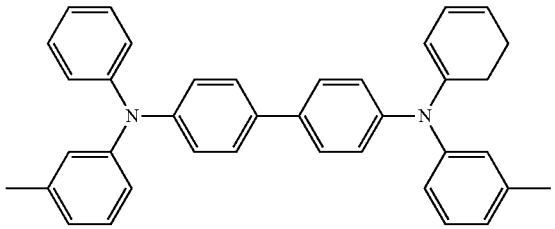
II-18
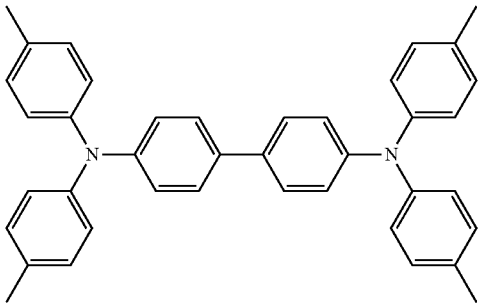
II-19
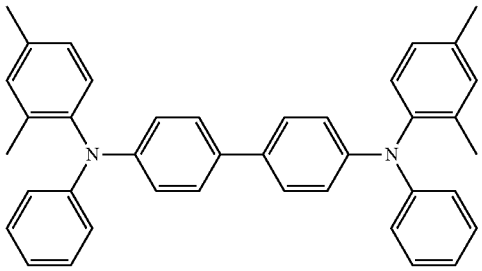
II-20
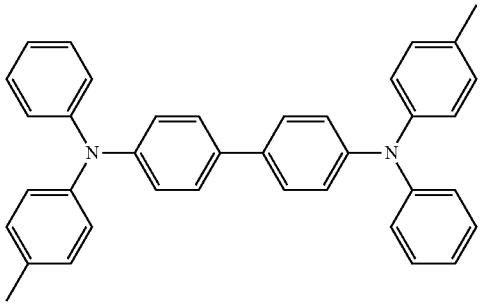
II-21
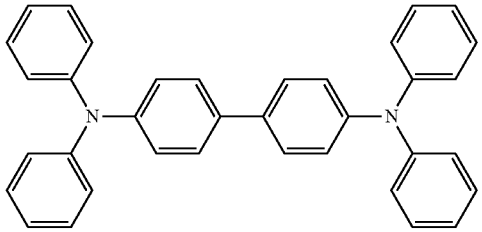

-continued
II-22
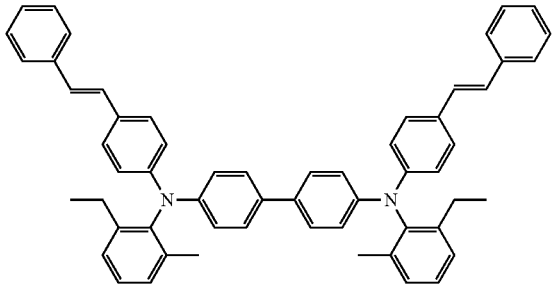
II-23
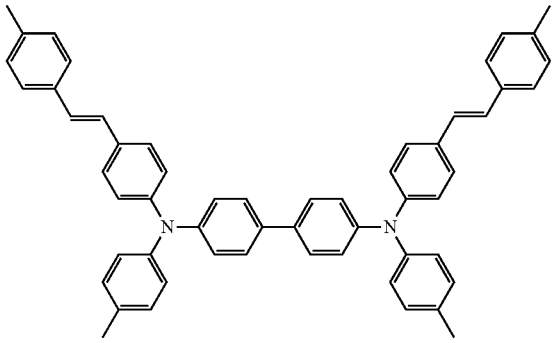
II-24
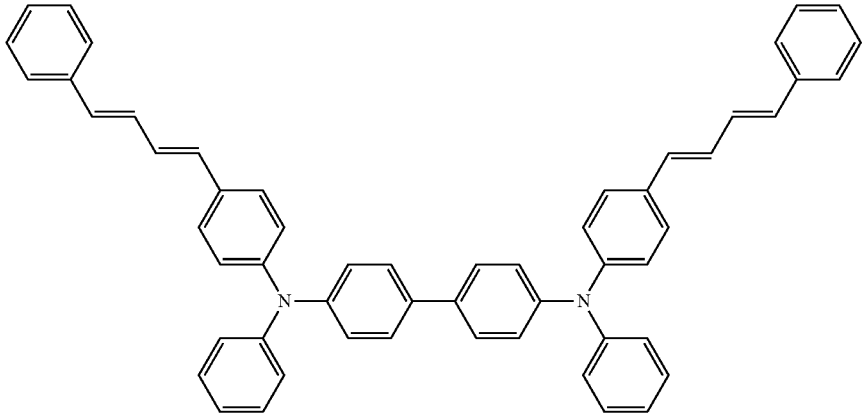
II-25
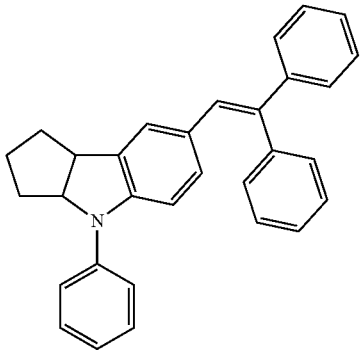
II-26
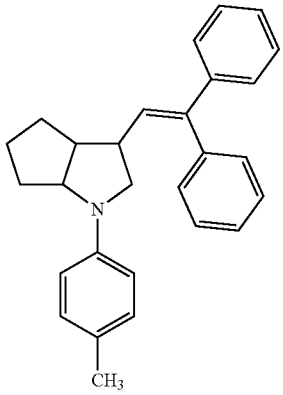
II-27
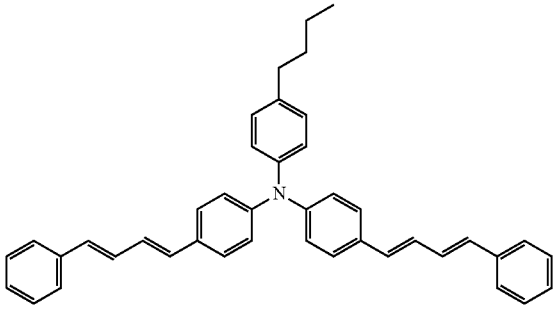
II-28
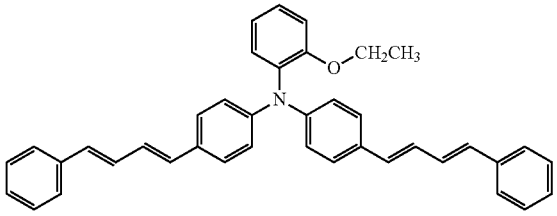

-continued
II-29
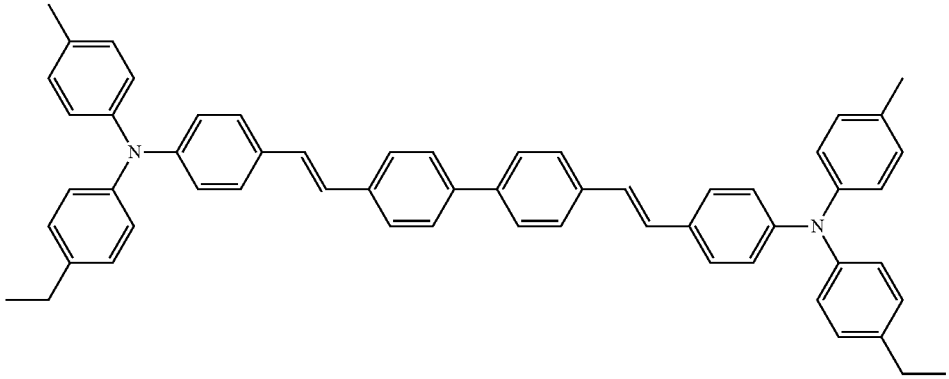
II-30
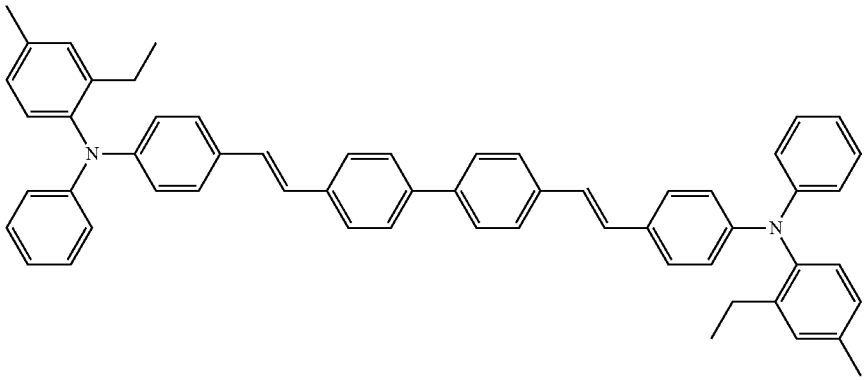
II-31
(1)
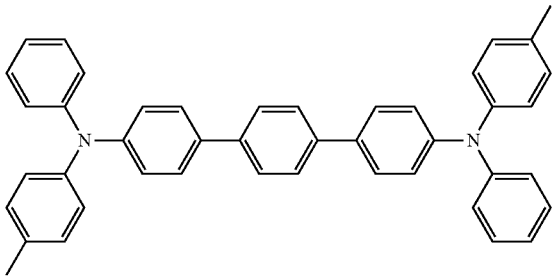
(2)
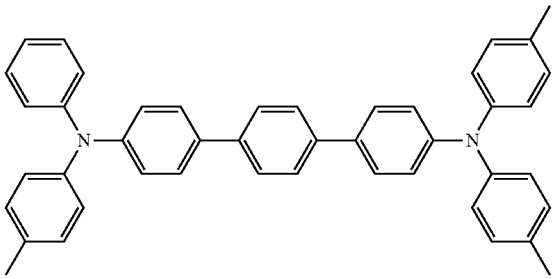
(3)
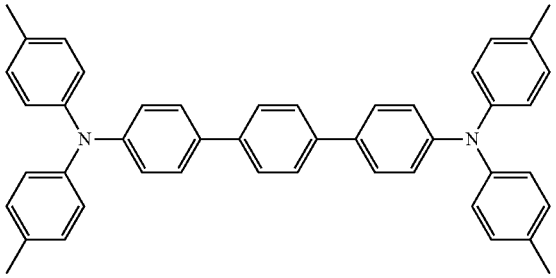
(1):(2):(3) = 1:2:1
Various types of polycarbonate resins such as polyarylate resin, bisphenol A, bisphenol Z, bisphenol C, a bisphenol A-biphenyl copolymer, and a bisphenol Z-biphenyl copolymer may be used singly or in combination as a resin binder in the charge transport layer 4. Further, resins of the same type with different molecular weights may be used in combination. In addition, polyphenylene resin, polyester resin, polyvinyl acetal resin, polyvinyl butyral resin, polyvinyl alcohol resin, vinyl chloride resin, vinyl acetate resin, polyethylene resin, polypropylene resin, acrylic resin, polyurethane resin, epoxy resin, melamine resin, silicone resin, polyamide resin, polystyrene resin, polyacetal resin, polysulfone resin, methacrylate polymers and copolymers thereof may be used.

The weight-average molecular weight of the other resins is suitably 5,000 to 250,000, more suitably 10,000 to 200,000 in a gel permeation chromatography (GPC) analysis in terms of polystyrene.

The resin binder in the charge transport layer 4 contains a resin having a viscosity-equivalent molecular weight (viscosity-average molecular weight) preferably equal to or greater than 15,000, suitably equal to or greater than 30,000 and equal to or less than 100,000, and more suitably equal to or greater than 40,000 and equal to or less than 80,000 and having a repeating unit expressed by structural formula (BD-1) below. By using such a resin binder, high durability in the photosensitive layer can be acquired.

(BD-1)

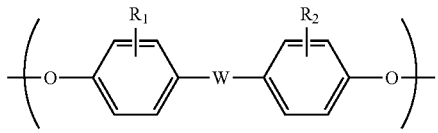

where, in the formula (BD-1), each of $R_1$ and $R_2$ represents a hydrogen atom or an alkyl group having 1 to 3 carbon atoms and W represents a single bond, an oxygen atom, a sulfur atom, or $CR_3R_4$, where each of $R_3$ and $R_4$ independently represents a hydrogen atom or an alkyl group having 1 to 3 carbon atoms, or $R_3$ and $R_4$ may be bonded to each other to form a substituted or unsubstituted cycloalkyl group having 5 to 6 carbon atoms.

Specific examples of such a resin include resins expressed by the following structural formulae CTB1 to CTB11 but are not limited thereto.

CTB1

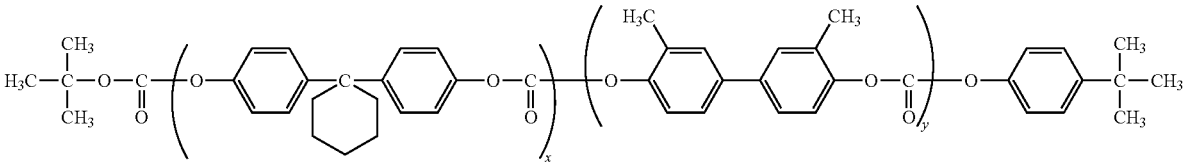

y / (x + y) = 0.4

CTB2

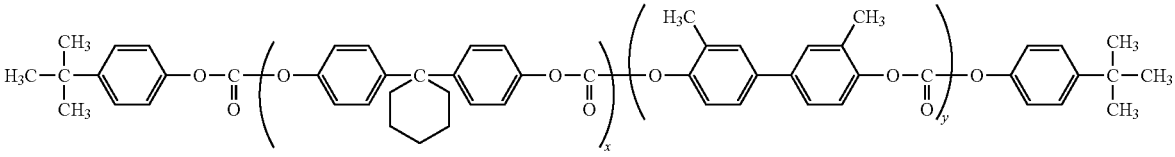

y / (x + y) = 0.5

CTB3

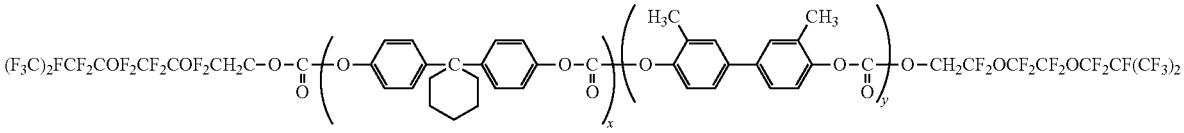

y / (x + y) = 0.4

CTB4

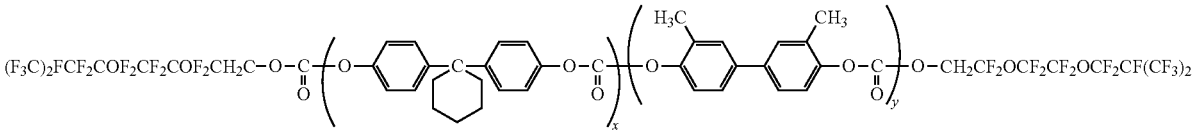

y / (x + y) = 0.5

CTB5

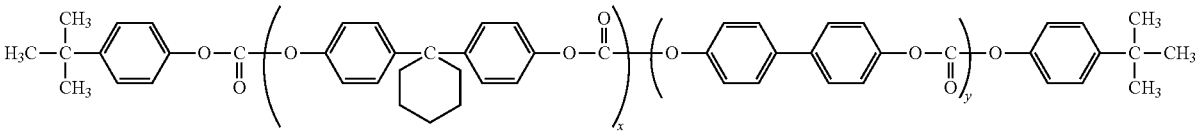

y / (x + y) = 0.15

-continued
CTB6
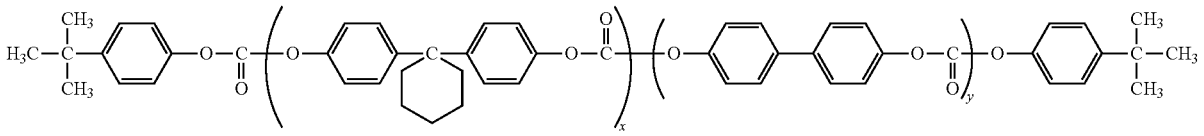
y / (x + y) = 0.4
CTB7
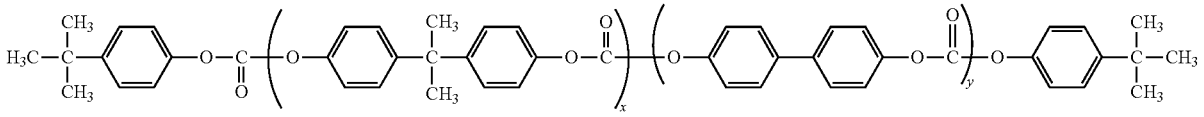
y / (x + y) = 0.15
CTB8
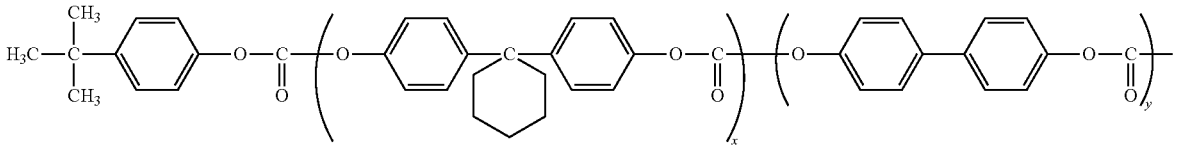
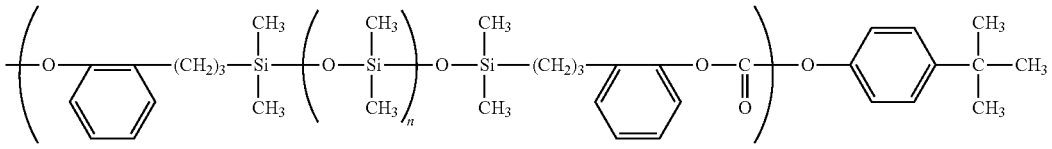
x / (x + y + z) = 0.85
z / (x + y + z) = 0.03
CTB9
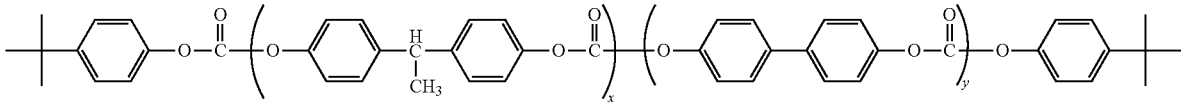
y / (x + y) = 0.15
CTB10
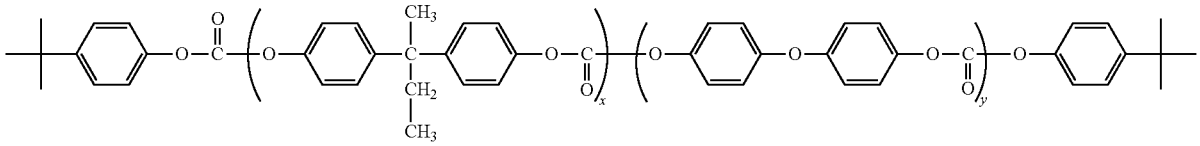
y / (x + y) = 0.70
CTB11
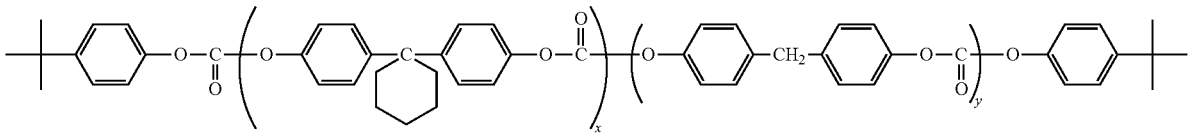
y / (x + y) = 0.50

It is preferable that one or more compounds expressed by the following structural formulae (E-1) to (E-5) be used as an electron transport material in the charge transport layer 4.

(E-1)

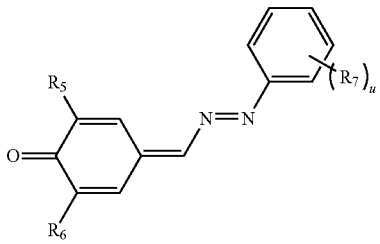

(E-2)

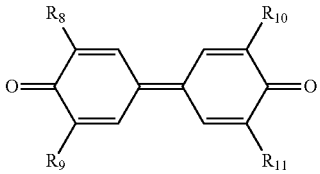

(E-3)

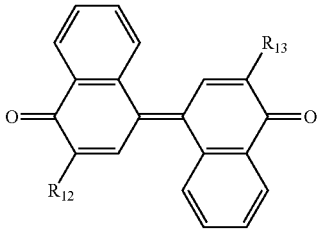

(E-4)

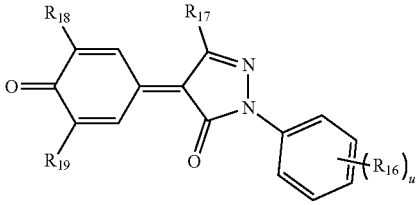

(E-5)

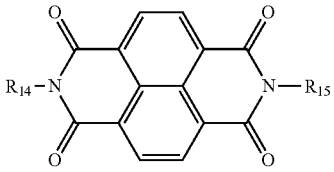

where, in the formulae (E-1), (E-2), (E-3), and (E-4), each of $R_5$, $R_6$, $R_7$, $R_8$, $R_9$, $R_{10}$, $R_{11}$, $R_{12}$, $R_{13}$, $R_{16}$, $R_{17}$, $R_{18}$, and $R_{19}$ independently represents a hydrogen atom, a halogen atom, a nitro group, a cyano group, an alkyl group having 1 to 6 carbon atoms that may have a substituent, an alkenyl group having 2 to 6 carbon atoms that may have a substituent, an alkoxy group having 1 to 6 carbon atoms that may have a substituent, an aryl group having 6 to 14 carbon atoms that may have a substituent, or a cycloalkyl group having 3 to 8 carbon atoms that may have a substituent, and u denotes an integer in a range of 0 to 5;

in the formula (E-5), each of $R_{14}$ and $R_{15}$ independently represents an aryl group having 6 to 14 carbon atoms that may have at least one alkyl group having 1 to 6 carbon atoms, an aryl group having 6 to 14 carbon atoms that may have a phenylcarbonyl group, an aralkyl group having 7 to 20 carbon atoms, an alkoxy group having 1 to 6 carbon atoms, an alkyl group having 1 to 8 carbon atoms that may have an alkylamino group, or a cycloalkyl group having 3 to 10 carbon atoms; and a selected group may be substituted by one or more halogen atoms.

Specific examples of such an electron transport material preferably include electron transport materials expressed by the following structural formulae (ETM1-1) to (ETM5-5) but are not limited thereto.

ETM1-1

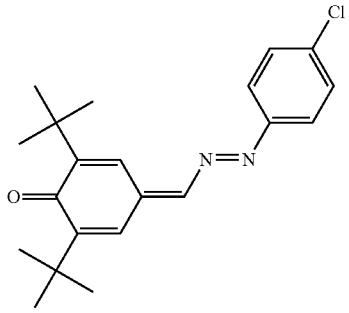

ETM2-1

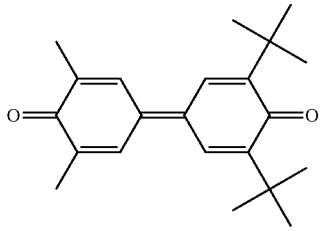

ETM2-2

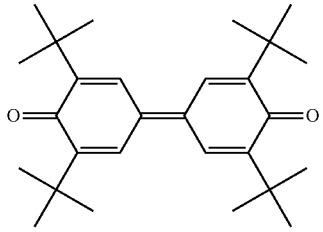

ETM2-3

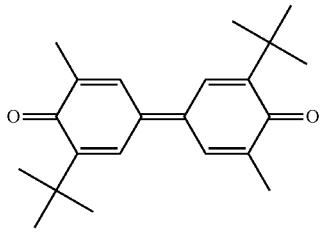

ETM3-1

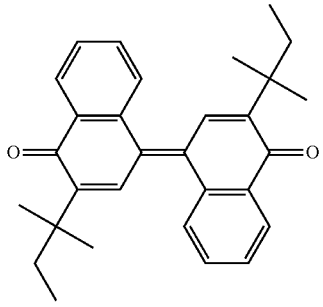

-continued

ETM4-1

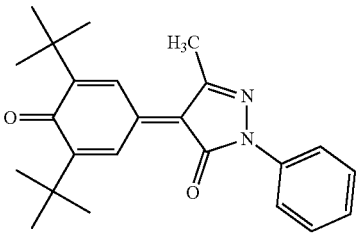

ETM4-2

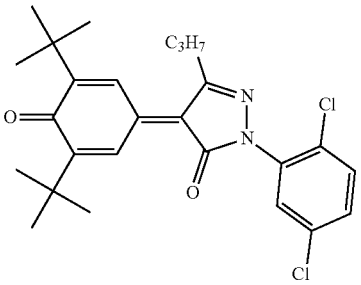

ETM4-3

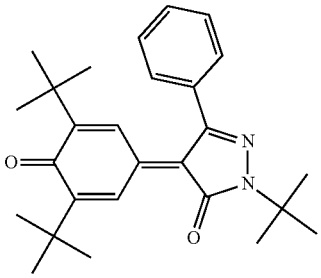

ETM4-4

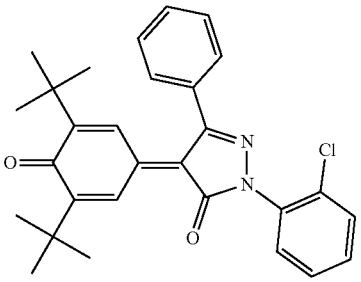

ETM5-1

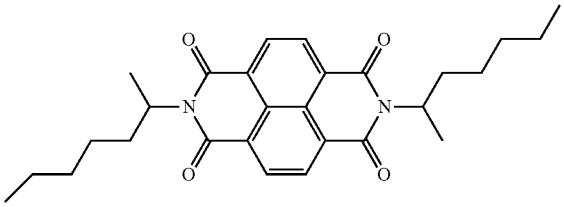

ETM5-2

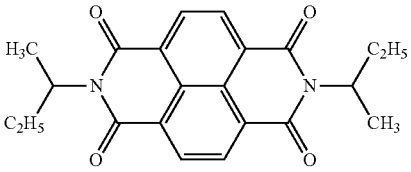

-continued

ETM5-3

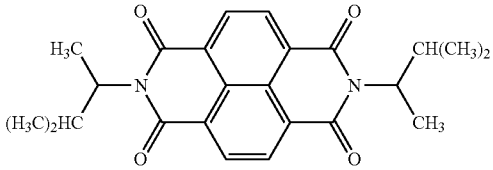

ETM5-4

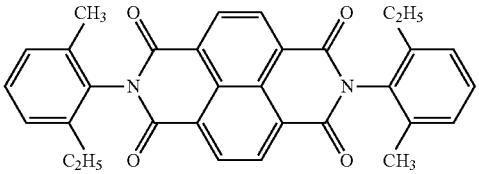

ETM5-5

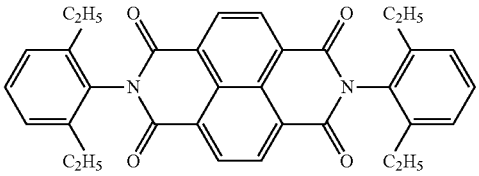

The inorganic oxide in the charge transport layer 4 is not particularly limited, but preferably contains silica as a main component and more preferably contains, in addition to silica as a main component, aluminum of equal to or greater than 1 ppm and equal to or less than 2000 ppm, particularly equal to or greater than 1 ppm and equal to or less than 1000 ppm. Further, the inorganic oxide is preferably subjected to surface treatment with a silane coupling agent.

As the silane coupling agent, an agent having a structure represented by general formula (1) below can be suitably used:

$$(R^{21})_n—Si—(OR^{22})_{4-n} \quad (1)$$

where Si represents a silicon atom, $R^{21}$ represents an organic group formed by directly bonding carbon to the silicon atom, $R^{22}$ represents an organic group, and n denotes an integer in a range of 0 to 3.

Further, the silane coupling agent also preferably contains a material selected from the group consisting of phenyltrimethoxysilane, vinyltrimethoxysilane, epoxytrimethoxysilane, methacryltrimethoxysilane, aminotrimethoxysilane, ureidotrimethoxysilane, mercaptopropyltrimethoxysilane, isocyanatepropyltrimethoxysilane, phenylaminotrimethoxysilane, acryltrimethoxysilane, p-styryltrimethoxysilane, 3-acryloxypropyltrimethoxysilane, 3-methacryloxypropyltrimethoxysilane, 3-isocyanatepropyltrimethoxysilane, 3-aminopropyltrimethoxysilane, N-phenyl-3-aminopropyltrimethoxysilane, and combinations thereof.

Furthermore, it is also preferable that the inorganic oxide be subjected to surface treatment with a plurality of types of silane coupling agents and a silane coupling agent first used in the surface treatment have the structure expressed by the general formula (1).

In addition, the primary particle diameter of the inorganic oxide is preferably 1 to 200 nm.

By using such an inorganic oxide, mechanical strength can be imparted to the charge transport layer without increasing aggregates in the charge transport layer.

In order to maintain practically effective surface potential, the film thickness of the charge transport layer 4 is preferably in a range of 3 to 50 μm and is more preferably in a range of 15 to 40 μm.

An antidegradant such as an antioxidant or a light stabilizer may be contained in the photosensitive layer as desired for the purpose of improving environmental resistance and stability against harmful light. Examples of a compound used for such a purpose include chromanol derivatives such as tocopherol, esterified compounds, polyarylalkane compounds, hydroquinone derivatives, etherified compounds, dietherified compounds, benzophenone derivatives, benzotriazole derivatives, thioether compounds, phenylenediamine derivatives, phosphonates, phosphites, phenol compounds, hindered phenol compounds, linear amine compounds, cyclic amine compounds, and hindered amine compounds.

Further, a leveling agent such as silicone oil or fluorine-based oil may also be contained in the photosensitive layer for the purpose of improving a leveling property of a formed film and imparting lubricity. Furthermore, in addition to an inorganic oxide subjected to surface treatment with a silane coupling agent, a metal oxide such as silicon oxide (silica), titanium oxide, zinc oxide, calcium oxide, aluminum oxide (alumina), or zirconium oxide, a metal sulfate such as barium sulfate or calcium sulfate, fine particles of metal nitride such as silicon nitride or aluminum nitride, particles of fluorine-based resin such as 4-fluoroethylene resin, fluorine-based comb-shaped graft polymer resin, or the like may be contained in the photosensitive layer for the purpose of adjusting film hardness, reducing a friction coefficient, imparting lubricity, and the like. In addition, other known additives may be contained as needed to the extent that electrophotographic characteristics are not remarkably impaired.

(Method of Manufacturing Photoconductor)

When manufacturing the electrophotographic photoconductor, a method of manufacturing a photoconductor according to the embodiment of the present invention includes forming the charge generation layer and charge transport layer by a dip coating method using a charge generation layer coating liquid for forming the charge generation layer and a charge transport layer coating liquid for forming the charge transport layer. The use of the dip coating method enables manufacture of a photoconductor with excellent appearance quality and stable electric characteristics while securing a low cost and high productivity. The manufacture of the photoconductor is not particularly limited to aspects other than use of the dip coating method and may be performed in accordance with a usual method. The manufacturing method may further include preparing an electroconductive substrate.

Specifically, for example, a charge generation layer coating liquid for forming a charge generation layer is first prepared by dissolving and dispersing the charge generation material in a solvent with any resin binder or the like, and a charge generation layer is formed by coating the charge generation layer coating liquid on the outer periphery of an electroconductive substrate through an undercoating layer as desired and drying the liquid. Next, a charge transport layer coating liquid for forming a charge transport layer is prepared by dissolving the hole transport material, any resin binder, an electron transport material, an inorganic oxide and the like in a solvent at a predetermined ratio, and a charge transport layer is formed by coating the charge transport layer coating liquid on the charge generation layer and drying the liquid; and thus a photoconductor can be manufactured. Types of solvents used for the preparation of the coating liquids, coating conditions, drying conditions of atmosphere such as air, temperature such as ambient, pressure, and relative humidity, and the like may be appropriately selected in accordance with a usual method and are not particularly limited.

(Electrophotographic Device)

An electrophotographic device according to the present invention is equipped with the photoconductor according to the present invention and provides expected effects by being applied to various types of machine processes. Specifically, sufficient effects can be acquired in charging processes such as a contact charging method using a charged member such as a roller or a brush, and a noncontact charging method using a corotron, a scorotron, or the like, and development processes such as a contact development method and a noncontact development method using development methods such as nonmagnetic one-component, magnetic one-component, and magnetic two-component development methods. The present invention is particularly useful in being capable of suppressing abrasion caused by contact between charged members when a charging process based on the contact charging method by which charged members are charged by contact with a photoconductor is provided.

Figure 2:
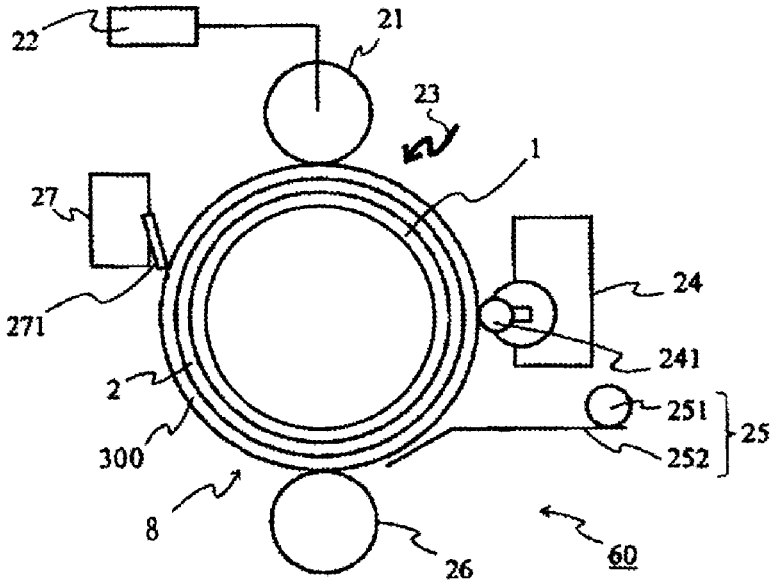
FIG. 2 is a schematic configuration diagram illustrating an example of an electrophotographic device according to the embodiment of the present invention.
Figure 3:
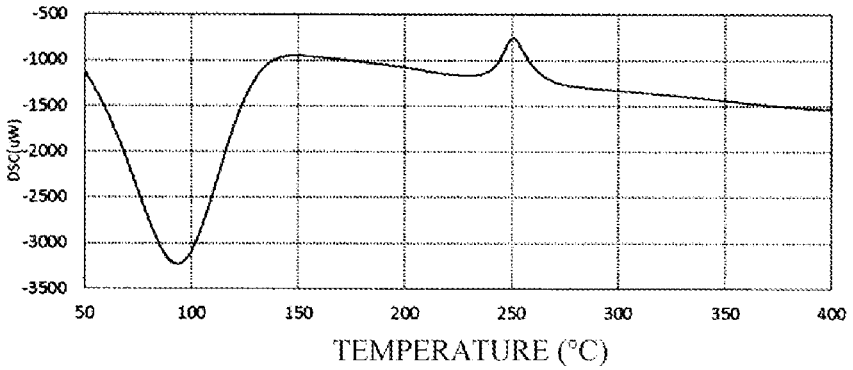
FIG. 3 is a DSC curve illustrating a differential scanning calorimetry result on titanyl phthalocyanine CGM1 used in Examples.
Figure 4:
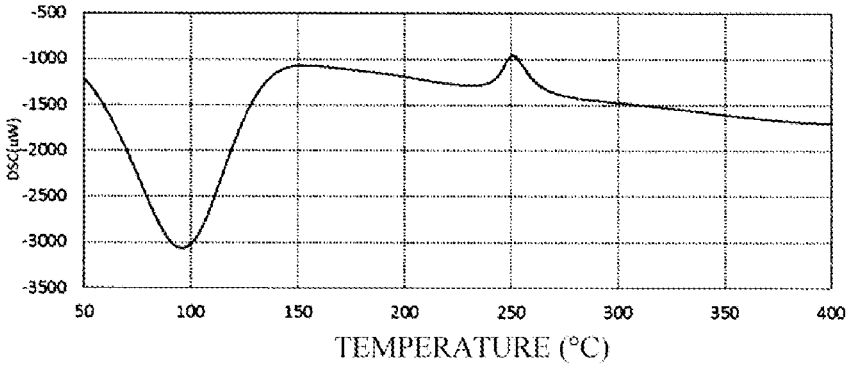
FIG. 4 is a DSC curve illustrating a differential scanning calorimetry result on titanyl phthalocyanine CGM2 used in Examples.
Figure 5:
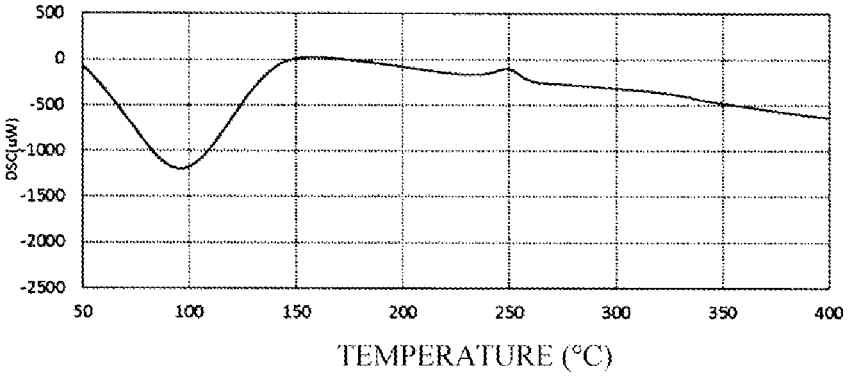
FIG. 5 is a DSC curve illustrating a differential scanning calorimetry result on titanyl phthalocyanine CGM3 used in Examples.
Figure 6:
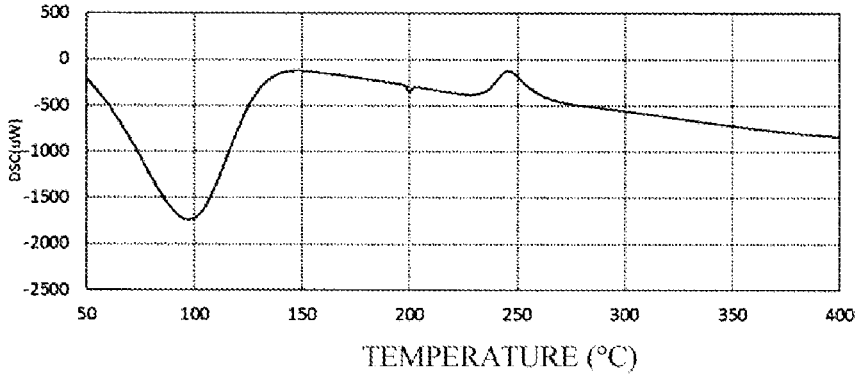
FIG. 6 is a DSC curve illustrating a differential scanning calorimetry result on titanyl phthalocyanine CGM4 used in Examples.
Figure 7:
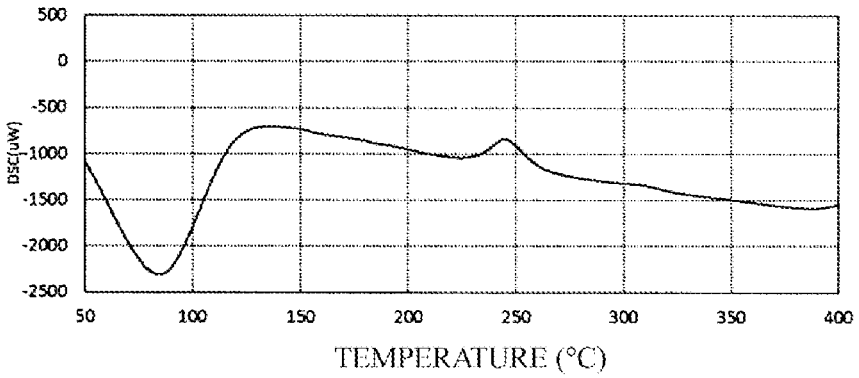
FIG. 7 is a DSC curve illustrating a differential scanning calorimetry result on titanyl phthalocyanine CGM5 used in Examples.
Figure 8:
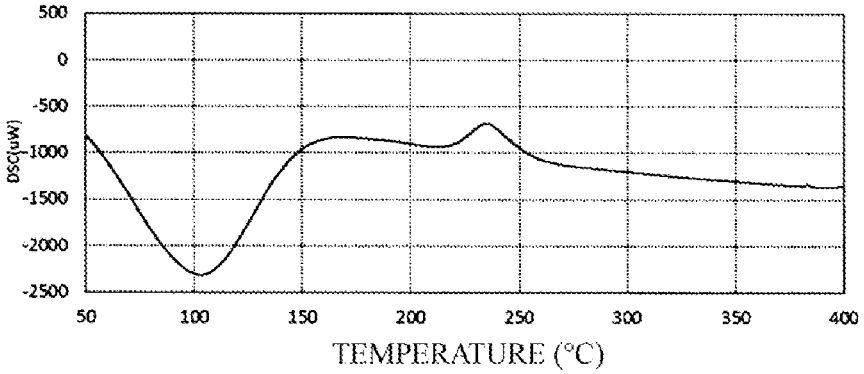
FIG. 8 is a DSC curve illustrating a differential scanning calorimetry result on titanyl phthalocyanine CGM6 used in Examples.

FIG. 2 illustrates a schematic configuration diagram of a configuration example of the electrophotographic device according to the present invention. An illustrated electrophotographic device 60 according to the present invention is equipped with a photoconductor 8 according to the present invention including an electroconductive substrate 1, and an undercoating layer 2 and a photosensitive layer 300 coated on the outer peripheral surface of the electroconductive substrate 1. The illustrated electrophotographic device 60 includes a charged member 21 placed on the outer periphery of the photoconductor 8, a high voltage power source 22 supplying applied voltage to the charged member 21, an image exposure member 23, a development device 24 including a development roller 241, a paper feeding member 25 including a paper feeding roller 251 and a paper feeding guide 252, and a transfer charger (direct charging type) 26. The electrophotographic device 60 may further include a cleaning device 27 including a cleaning blade 271 and an unillustrated antistatic member. Further, the electrophotographic device 60 according to the present invention may be a color printer.

EXAMPLES

Specific embodiments of the present invention will be described in more detail below with reference to Examples. The present invention is not limited to the following Examples as long as the gist of the present invention is not exceeded.

(Manufacture of Negatively-Charged Multilayer Photoconductor)

Example 1

A coating liquid 1 was prepared by dissolving and dispersing 3 parts by mass of alcohol-soluble nylon (product name: "CM8000" manufactured by Toray Industries, Inc.) and 7 parts by mass of aminosilane treated titanium oxide fine particles in 80 parts by mass of methanol and 10 parts by mass of isopropyl alcohol. An undercoating layer 2 with a film thickness of 2 μm was formed by dip coating the coating liquid 1 on the outer periphery of an aluminum cylinder as an electroconductive substrate 1, the cylinder having an outer diameter of 30 mm, and drying the liquid for 30 minutes at a temperature of 120° C.

A coating liquid 2 was prepared by dissolving and dispersing 2 parts by mass of CGM1 (titanyl phthalocyanine described in Example 1 in JP2008-174677A) shown in Tables below as a charge generation material (CGM), 0.5 parts by mass of "S-LEC BM-2" (product name) and 0.5 parts by mass of "S-LEC BX-L" (product name) each of which is polyvinyl butyral resin as a resin binder and is manufactured by Sekisui Chemical Co. in 80 parts by mass of methyl ethyl ketone. The coating liquid 2 was dip coated on the undercoating layer 2. A charge generation layer 3 with a film thickness of 0.3 μm was formed by drying the liquid for 30 minutes at a temperature of 80° C.

Further, 4 parts by mass of a compound expressed by the formula HTM1-1 as a hole transport material (HTM), 16 parts by mass of resin (viscosity-equivalent molecular weight: 55,000) as a resin binder (CTB) having a repeating unit expressed by the formula CTB1, and 0.1 parts by mass of a compound expressed by the formula ETM1-1 as an electron transport material (ETM) were dissolved in 120 parts by mass of tetrahydrofuran.

Next, using silica YA050C (aluminum content: 900 ppm) manufactured by Admatechs Co., Ltd. as an inorganic oxide, 1 part by mass of surface-treated silica subjected to surface treatment by using phenyltrimethoxysilane as a surface treatment agent at 0.8% by mass loading on silica was prepared and was dispersed in 10 parts by mass of tetrahydrofuran. A coating liquid 3 was produced by adding a liquid in which the hole transport material and the like are dissolved to the silica dispersion and stirring the mixture.

A charge transport layer 4 with a film thickness of 25 μm was formed by dip coating the coating liquid 3 on the charge generation layer 3 and drying the liquid for 60 minutes at a temperature of 120° C., and thus a negatively-charged multilayer photoconductor was produced.

Examples 2 to 47

Photoconductors were similarly prepared by changing the compositions of Example 1 in accordance with the conditions shown in Tables below.

As the inorganic oxides, those shown in Table 9 below were used.

TABLE 9

| | Inorganic oxide | | | Surface treatment agent | |
|---|---|---|---|---|---|
| | Name | Primary particle diameter (nm) | Al Content (ppm) | Surface treatment agent 1 | Surface treatment agent 2 |
| F1 | Silica A*1 | 10 | 500 | Phenyltrimethoxysilane | — |
| F2 | Silica D*2 | 50 | 900 | Phenyltrimethoxysilane | — |
| F3 | Silica E*3 | 100 | 900 | Phenyltrimethoxysilane | — |
| F4 | Silica D*2 | 50 | 900 | KBM573*7 | — |
| F5 | Silica D*2 | 50 | 900 | Phenyltrimethoxysilane | KBM573 |
| F6 | Silica F*4 | 100 | 10 | Phenyltrimethoxysilane | — |
| F7 | Silica G*5 | 100 | 100 | Phenyltrimethoxysilane | — |
| F8 | Silica H*6 | 100 | 2000 | Phenyltrimethoxysilane | — |

*1Silica A: YA010C manufactured by Admatechs Co., Ltd., primary particle diameter: 10 nm
*2Silica D: YA050C manufactured by Admatechs Co., Ltd., primary particle diameter: 50 nm
*3Silica E: YA100C manufactured by Admatechs Co., Ltd., primary particle diameter: 100 nm
*4Silica F: Silica adjusted to aluminum content of 10 ppm in accordance with the test example method described in JP2015-117138A, primary particle diameter: 100 nm
*5Silica G: Silica adjusted to aluminum content of 100 ppm in accordance with the test example method described in JP2015-117138A, primary particle diameter: 100 nm
*6Silica H: Silica adjusted to aluminum content of 2000 ppm in accordance with the test example method described in JP2015-117138A, primary particle diameter: 100 nm
*7KBM573: N-phenyl-3-aminopropyltrimethoxysilane manufactured by Shin-Etsu Chemical Co., Ltd.

Further, titanyl phthalocyanine shown in Table 10 below was used as the charge generation material (CGM).

TABLE 10

| Charge generation material | Type | Peak temperature (° C.) | Peak heat value (mJ/mg) | Half-value width (° C.) |
|---|---|---|---|---|
| CGM1 | Example 1, JP2008-174677A | 250.7 | 3.36 | 13.2 |
| CGM2 | Example 2, JP2008-174677A | 250.8 | 3.10 | 13.0 |
| CGM3 | Synthesis Example 3, JP2000-239557A | 245.6 | 3.19 | 15.6 |
| CGM4 | Manufacturing Example 3, JP2004-002874A | 248.9 | 0.86 | 11.8 |
| CGM5 | CG-01H manufactured by IT-Chem Co. Ltd. | 244.3 | 3.24 | 20.7 |
| CGM6 | TPL-3 manufactured by Orient Chemical Industries Co., Ltd. | 233.6 | 4.52 | 17.1 |

<Differential Scanning Calorimetry (DSC)>

Differential scanning calorimetry was performed on titanyl phthalocyanine as each of CGM1 to CGM6. The differential scanning calorimetry was performed using sample amounts of 5 to 10 mg by use of DSC7020 manufactured by Hitachi High-Tech Science Corporation under a condition of a temperature rise speed of 20° C./min from 20 to 420° C. by use of a dedicated aluminum pan. Heat values and half-value widths were acquired as described above. DSC curves of CGM1 to CGM6 are respectively illustrated in FIGS. 3 to 8.

<X-Ray Diffraction>

Further, an X-ray diffraction measurement was performed on the phthalocyanine as CGM1. The measurement was performed as follows.

A sample being 0.3 g of Y-type phthalocyanine was kept for 24 hours under a condition of a temperature of 23±1° C. and relative humidity of 50 to 60% RH and then was set on a sample holder in an X-ray diffraction device (D8 DISCOVER manufactured by Bruker Corporation) for measurement.

Conditions of the measuring device are as follows:

Incidence-side optical system: radiation source: CuKα (1=1.542 Å), output: 50 kV, 100 mA, monochromator: multilayer film mirror, beam size: 10 mm (H)×1.0 mm (W)

Light-receiving-side optical system: 0.12° parallel-plate collimator, detector: scintillation counter Scanning condition: scanning rate: 3 deg/min, step width: 0.02°, start angle 5.0°, stop angle 35.0°

Figure 9:
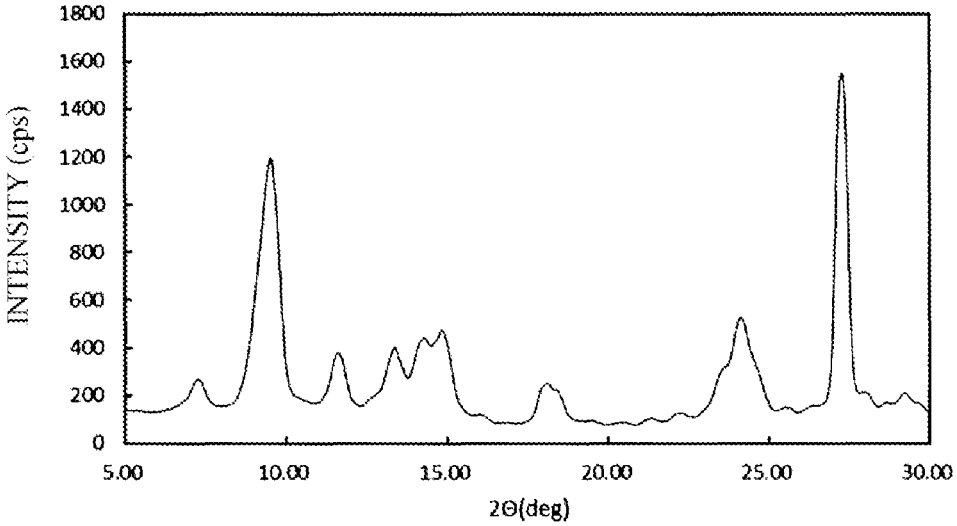
FIG. 9 is a graph illustrating an X-ray diffraction spectrum measurement result on titanyl phthalocyanine CGM1 used in Examples.

The acquired X-ray diffraction spectrum of CGM1 is depicted in FIG. 9. Every sample of titanyl phthalocyanine described in Table 10 was a high-sensitivity titanyl phthalocyanine having a peak at 2θ=27.2±0.3° in the X-ray diffraction.

TABLE 11

| | Charge generation layer condition | Charge transport layer condition | | | | | | | |
|---|---|---|---|---|---|---|---|---|---|
| | CGM | HTM | | CTB | | ETM | | Inorganic oxide | |
| | Type | Type | Amount | Type | Amount | Type | Amount | Type | Amount |
| Example 1 | CGM1 | HTM1-1 | 4 | CTB1 | 16 | ETM1-1 | 0.1 | F2 | 1 |
| Example 2 | CGM1 | HTM1-1 | 4 | CTB1 | 16 | ETM1-1 | 0.1 | F2 | 2 |
| Example 3 | CGM1 | HTM1-1 | 4 | CTB1 | 16 | ETM1-1 | 0.1 | F2 | 2.5 |
| Example 4 | CGM1 | HTM1-1 | 4 | CTB1 | 16 | ETM1-1 | 0.1 | F2 | 0.5 |
| Example 5 | CGM1 | HTM1-1 | 5 | CTB1 | 15 | ETM1-1 | 0.1 | F2 | 1 |
| Example 6 | CGM1 | HTM1-1 | 6 | CTB1 | 14 | ETM1-1 | 0.1 | F2 | 1 |
| Example 7 | CGM1 | HTM1-1 | 3 | CTB1 | 17 | ETM1-1 | 0.02 | F2 | 2 |
| Example 8 | CGM1 | HTM1-1 | 3 | CTB1 | 17 | ETM1-1 | 0.1 | F2 | 1 |
| Example 9 | CGM1 | HTM1-1 | 3 | CTB1 | 17 | ETM1-1 | 1 | F2 | 1 |
| Example 10 | CGM1 | HTM1-1 | 3 | CTB1 | 17 | ETM1-1 | 1 | F2 | 2 |
| Example 11 | CGM1 | HTM1-1 | 8 | CTB1 | 12 | ETM1-1 | 1 | F2 | 0.4 |
| Example 12 | CGM1 | HTM1-1 | 8 | CTB1 | 12 | ETM1-1 | 0.5 | F2 | 1 |
| Example 13 | CGM2 | HTM1-1 | 4 | CTB1 | 16 | ETM1-1 | 0.1 | F2 | 1 |
| Example 14 | CGM1 | HTM1-5 | 4 | CTB1 | 16 | ETM1-1 | 0.1 | F2 | 1 |
| Example 15 | CGM1 | HTM1-12 | 4 | CTB1 | 16 | ETM1-1 | 0.1 | F2 | 1 |
| Example 16 | CGM1 | HTM1-14 | 4 | CTB1 | 16 | ETM1-1 | 0.1 | F2 | 1 |
| Example 17 | CGM1 | HTM1-23 | 4 | CTB1 | 16 | ETM1-1 | 0.1 | F2 | 1 |
| Example 18 | CGM1 | HTM1-33 | 4 | CTB1 | 16 | ETM1-1 | 0.1 | F2 | 1 |
| Example 19 | CGM1 | HTM2-1 | 4 | CTB1 | 16 | ETM1-1 | 0.1 | F2 | 1 |
| Example 20 | CGM1 | HTM2-8 | 4 | CTB1 | 16 | ETM1-1 | 0.1 | F2 | 1 |
| Example 21 | CGM1 | HTM2-15 | 4 | CTB1 | 16 | ETM1-1 | 0.1 | F2 | 1 |
| Example 22 | CGM1 | HTM2-36 | 4 | CTB1 | 16 | ETM1-1 | 0.1 | F2 | 1 |
| Example 23 | CGM1 | HTM2-73 | 4 | CTB1 | 16 | ETM1-1 | 0.1 | F2 | 1 |
| Example 24 | CGM1 | HTM2-87 | 4 | CTB1 | 16 | ETM1-1 | 0.1 | F2 | 1 |

TABLE 12

| | Charge generation layer condition | Charge transport layer condition | | | | | | | |
|---|---|---|---|---|---|---|---|---|---|
| | CGM | HTM | | CTB* | | ETM** | | Inorganic oxide | |
| | Type | Type | Amount | Type | Amount | Type | Amount | Type | Amount |
| Example 25 | CGM1 | HTM1-1 | 2 | CTB1 | 16 | ETM1-1 | 0.1 | F2 | 1 |
| | | HTM2-1 | 2 | | | | | | |
| Example 26 | CGM1 | HTM1-1 | 4 | CTB1 | 16 | ETM2-2 | 0.1 | F2 | 1 |
| Example 27 | CGM1 | HTM1-1 | 4 | CTB1 | 16 | ETM3-1 | 0.1 | F2 | 1 |
| Example 28 | CGM1 | HTM1-1 | 4 | CTB1 | 16 | ETM4-2 | 0.1 | F2 | 1 |
| Example 29 | CGM1 | HTM1-1 | 4 | CTB1 | 16 | ETM5-1 | 0.1 | F2 | 1 |
| Example 30 | CGM1 | HTM1-1 | 4 | CTB1 | 16 | ETM1-1 | 0.05 | F2 | 1 |
| | | | | | | ETM5-1 | 0.05 | | |
| Example 31 | CGM1 | HTM1-1 | 4 | CTB3 | 16 | ETM1-1 | 0.1 | F2 | 1 |
| Example 32 | CGM1 | HTM1-1 | 4 | CTB4 | 16 | ETM1-1 | 0.1 | F2 | 1 |
| Example 33 | CGM1 | HTM1-1 | 4 | CTB6 | 16 | ETM1-1 | 0.1 | F2 | 1 |
| Example 34 | CGM1 | HTM1-1 | 4 | CTB11 | 16 | ETM1-1 | 0.1 | F2 | 1 |
| Example 35 | CGM1 | HTM1-1 | 4 | CTB4 | 12 | ETM1-1 | 0.1 | F2 | 1 |
| | | | | CTB8 | 4 | | | | |
| Example 36 | CGM1 | HTM1-1 | 4 | CTB1 | 16 | ETM1-1 | 0.1 | Fl | 1 |
| Example 37 | CGM2 | HTM1-1 | 4 | CTB1 | 16 | ETM1-1 | 0.1 | F3 | 1 |
| Example 38 | CGM1 | HTM1-1 | 4 | CTB1 | 16 | ETM1-1 | 0.1 | F4 | 1 |
| Example 39 | CGM1 | HTM1-1 | 4 | CTB1 | 16 | ETM1-1 | 0.1 | F5 | 1 |
| Example 40 | CGM1 | HTM1-1 | 4 | CTB1 | 16 | ETM1-1 | 0.1 | F6 | 1 |
| Example 41 | CGM1 | HTM1-1 | 4 | CTB1 | 16 | ETM1-1 | 0.1 | F7 | 1 |
| Example 42 | CGM1 | HTM1-1 | 4 | CTB1 | 16 | ETM1-1 | 0.1 | F8 | 1 |
| Example 43 | CGM1 | HTM1-1 | 4 | CTB1 | 16 | ETM1-1 | 0.1 | F3 | 0.5 |
| | | | | | | | | F2 | 0.5 |
| Example 44 | CGM1 | HTM1-1 | 4 | CTB12 | 16 | ETM1-1 | 0.1 | F1 | 1 |
| Example 45 | CGM1 | HTM1-1 | 4 | CTB12 | 16 | ETM1-1 | 0.1 | F1 | 1 |

TABLE 12-continued

| | Charge generation layer condition | Charge transport layer condition | | | | | | | |
|---|---|---|---|---|---|---|---|---|---|
| | CGM | HTM | | CTB* | | ETM** | | Inorganic oxide | |
| | Type | Type | Amount | Type | Amount | Type | Amount | Type | Amount |
| Example 46 | CGM1 | HTM1-1 | 4 | CTB1 | 16 | ETM6-1 | 0.1 | F1 | 1 |
| Example 47 | CGM1 | HTM1-1 | 4 | CTB1 | 16 | ETM6-2 | 0.1 | F1 | 1 |

*CTB3: a resin having a repeating unit expressed by the formula CTB3 (viscosity-equivalent molecular weight: 60,000).
CTB4: a resin having a repeating unit expressed by the formula CTB4 (viscosity-equivalent molecular weight: 60,000).
CTB6: a resin having a repeating unit expressed by the formula CTB6 (viscosity-equivalent molecular weight: 50,000).
CTB8: a resin having a repeating unit expressed by the formula CTB8 (viscosity-equivalent molecular weight: 30,000).
CTB11: a resin having a repeating unit expressed by the formula CTB11 (viscosity-equivalent molecular weight: 15,000).
CTB12: a resin having a repeating unit expressed by the formula CTB5 (viscosity-equivalent molecular weight: 14,000).
**ETM6-1: a compound having a structure expressed by the following structural formula.

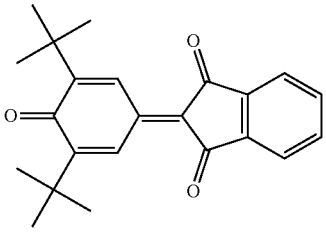

ETM6-2: a compound having a structure expressed by the following structural formula.

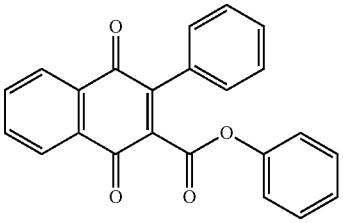

TABLE 13

| | Charge transport layer condition | | | | | | | | |
|---|---|---|---|---|---|---|---|---|---|
| | HTM | CTB | ETM | Inorganic oxide | | | | | |
| | Ratios in solid content | | | | Ratios | | | | |
| | a | b | c | d | b/a | c/a | d/a | c + d | c/d |
| Example 1 | 0.190 | 0.758 | 0.005 | 0.047 | 4.00 | 0.025 | 0.250 | 0.052 | 0.100 |
| Example 2 | 0.181 | 0.724 | 0.005 | 0.090 | 4.00 | 0.025 | 0.500 | 0.095 | 0.050 |
| Example 3 | 0.177 | 0.708 | 0.004 | 0.111 | 4.00 | 0.025 | 0.625 | 0.115 | 0.040 |
| Example 4 | 0.194 | 0.777 | 0.005 | 0.024 | 4.00 | 0.025 | 0.125 | 0.029 | 0.200 |
| Example 5 | 0.237 | 0.711 | 0.005 | 0.047 | 3.00 | 0.020 | 0.200 | 0.052 | 0.100 |
| Example 6 | 0.284 | 0.664 | 0.005 | 0.047 | 2.33 | 0.017 | 0.167 | 0.052 | 0.100 |
| Example 7 | 0.136 | 0.772 | 0.001 | 0.091 | 5.67 | 0.007 | 0.667 | 0.092 | 0.010 |
| Example 8 | 0.142 | 0.806 | 0.005 | 0.047 | 5.67 | 0.033 | 0.333 | 0.052 | 0.100 |
| Example 9 | 0.136 | 0.773 | 0.045 | 0.045 | 5.67 | 0.333 | 0.333 | 0.091 | 1.000 |
| Example 10 | 0.130 | 0.739 | 0.043 | 0.087 | 5.67 | 0.333 | 0.667 | 0.130 | 0.500 |
| Example 11 | 0.374 | 0.561 | 0.047 | 0.019 | 1.50 | 0.125 | 0.050 | 0.065 | 2.500 |
| Example 12 | 0.372 | 0.558 | 0.023 | 0.047 | 1.50 | 0.063 | 0.125 | 0.070 | 0.500 |
| Example 13 | 0.190 | 0.758 | 0.005 | 0.047 | 4.00 | 0.025 | 0.250 | 0.052 | 0.100 |
| Example 14 | 0.190 | 0.758 | 0.005 | 0.047 | 4.00 | 0.025 | 0.250 | 0.052 | 0.100 |
| Example 15 | 0.190 | 0.758 | 0.005 | 0.047 | 4.00 | 0.025 | 0.250 | 0.052 | 0.100 |
| Example 16 | 0.190 | 0.758 | 0.005 | 0.047 | 4.00 | 0.025 | 0.250 | 0.052 | 0.100 |
| Example 17 | 0.190 | 0.758 | 0.005 | 0.047 | 4.00 | 0.025 | 0.250 | 0.052 | 0.100 |
| Example 18 | 0.190 | 0.758 | 0.005 | 0.047 | 4.00 | 0.025 | 0.250 | 0.052 | 0.100 |
| Example 19 | 0.190 | 0.758 | 0.005 | 0.047 | 4.00 | 0.025 | 0.250 | 0.052 | 0.100 |
| Example 20 | 0.190 | 0.758 | 0.005 | 0.047 | 4.00 | 0.025 | 0.250 | 0.052 | 0.100 |
| Example 21 | 0.190 | 0.758 | 0.005 | 0.047 | 4.00 | 0.025 | 0.250 | 0.052 | 0.100 |
| Example 22 | 0.190 | 0.758 | 0.005 | 0.047 | 4.00 | 0.025 | 0.250 | 0.052 | 0.100 |
| Example 23 | 0.190 | 0.758 | 0.005 | 0.047 | 4.00 | 0.025 | 0.250 | 0.052 | 0.100 |

TABLE 14

| | Charge transport layer condition | | | | | | | | |
|---|---|---|---|---|---|---|---|---|---|
| | HTM | CTB | ETM | Inorganic oxide | | | | | |
| | Ratios in solid content | | | | Ratios | | | | |
| | a | b | c | d | b/a | c/a | d/a | c + d | c/d |
| Example 24 | 0.190 | 0.758 | 0.005 | 0.047 | 4.00 | 0.025 | 0.250 | 0.052 | 0.100 |
| Example 25 | 0.190 | 0.758 | 0.005 | 0.047 | 4.00 | 0.025 | 0.250 | 0.052 | 0.100 |
| Example 26 | 0.190 | 0.758 | 0.005 | 0.047 | 4.00 | 0.025 | 0.250 | 0.052 | 0.100 |
| Example 27 | 0.190 | 0.758 | 0.005 | 0.047 | 4.00 | 0.025 | 0.250 | 0.052 | 0.100 |
| Example 28 | 0.190 | 0.758 | 0.005 | 0.047 | 4.00 | 0.025 | 0.250 | 0.052 | 0.100 |
| Example 29 | 0.190 | 0.758 | 0.005 | 0.047 | 4.00 | 0.025 | 0.250 | 0.052 | 0.100 |
| Example 30 | 0.190 | 0.758 | 0.005 | 0.047 | 4.00 | 0.025 | 0.250 | 0.052 | 0.100 |
| Example 31 | 0.190 | 0.758 | 0.005 | 0.047 | 4.00 | 0.025 | 0.250 | 0.052 | 0.100 |
| Example 32 | 0.190 | 0.758 | 0.005 | 0.047 | 4.00 | 0.025 | 0.250 | 0.052 | 0.100 |
| Example 33 | 0.190 | 0.758 | 0.005 | 0.047 | 4.00 | 0.025 | 0.250 | 0.052 | 0.100 |
| Example 34 | 0.190 | 0.758 | 0.005 | 0.047 | 4.00 | 0.025 | 0.250 | 0.052 | 0.100 |
| Example 35 | 0.190 | 0.758 | 0.005 | 0.047 | 4.00 | 0.025 | 0.250 | 0.052 | 0.100 |
| Example 36 | 0.190 | 0.758 | 0.005 | 0.047 | 4.00 | 0.025 | 0.250 | 0.052 | 0.100 |
| Example 37 | 0.190 | 0.758 | 0.005 | 0.047 | 4.00 | 0.025 | 0.250 | 0.052 | 0.100 |
| Example 38 | 0.190 | 0.758 | 0.005 | 0.047 | 4.00 | 0.025 | 0.250 | 0.052 | 0.100 |
| Example 39 | 0.190 | 0.758 | 0.005 | 0.047 | 4.00 | 0.025 | 0.250 | 0.052 | 0.100 |
| Example 40 | 0.190 | 0.758 | 0.005 | 0.047 | 4.00 | 0.025 | 0.250 | 0.052 | 0.100 |
| Example 41 | 0.190 | 0.758 | 0.005 | 0.047 | 4.00 | 0.025 | 0.250 | 0.052 | 0.100 |
| Example 42 | 0.190 | 0.758 | 0.005 | 0.047 | 4.00 | 0.025 | 0.250 | 0.052 | 0.100 |
| Example 43 | 0.190 | 0.758 | 0.005 | 0.047 | 4.00 | 0.025 | 0.250 | 0.052 | 0.100 |
| Example 44 | 0.190 | 0.758 | 0.005 | 0.047 | 4.00 | 0.025 | 0.250 | 0.052 | 0.100 |
| Example 45 | 0.190 | 0.758 | 0.005 | 0.047 | 4.00 | 0.025 | 0.250 | 0.052 | 0.100 |
| Example 46 | 0.190 | 0.758 | 0.005 | 0.047 | 4.00 | 0.025 | 0.250 | 0.052 | 0.100 |
| Example 47 | 0.190 | 0.758 | 0.005 | 0.047 | 4.00 | 0.025 | 0.250 | 0.052 | 0.100 |

Comparative Examples 1 to 17

Photoconductors were similarly prepared by changing the composition of Example 1 in accordance with the conditions shown in Tables below.

TABLE 15

| | Charge generation layer condition CGM | Charge transport layer condition | | | | | | | |
|---|---|---|---|---|---|---|---|---|---|
| | | HTM | | CTB | | ETM | | Inorganic oxide | |
| | Type | Type | Amount | Type | Amount | Type | Amount | Type | Amount |
| Comparative Example 1 | CGM1 | HTM1-1 | 8.5 | CTB1 | 11.5 | ETM1-1 | 0.1 | F1 | 1 |
| Comparative Example 2 | CGM1 | HTM1-1 | 4 | CTB1 | 16 | ETM1-1 | 0.01 | F1 | 1 |
| Comparative Example 3 | CGM1 | HTM1-1 | 4 | CTB1 | 16 | ETM1-1 | 0.1 | F1 | 0.15 |
| Comparative Example 4 | CGM1 | HTM1-1 | 3 | CTB1 | 17 | ETM1-1 | 0.1 | F1 | 3 |
| Comparative Example 5 | CGM3 | HTM1-1 | 4 | CTB1 | 16 | ETM1-1 | 0.1 | F1 | 1 |
| Comparative Example 6 | CGM4 | HTM1-1 | 4 | CTB1 | 16 | ETM1-1 | 0.1 | F1 | 1 |
| Comparative Example 7 | CGM5 | HTM1-1 | 4 | CTB1 | 16 | ETM1-1 | 0.1 | F1 | 1 |
| Comparative Example 8 | CGM6 | HTM1-1 | 4 | CTB1 | 16 | ETM1-1 | 0.1 | F1 | 1 |
| Comparative Example 9 | CGM3 | HTM2-1 | 4 | CTB1 | 16 | ETM1-1 | 0.1 | F1 | 1 |
| Comparative Example 10 | CGM4 | HTM2-1 | 4 | CTB1 | 16 | ETM1-1 | 0.1 | F1 | 1 |
| Comparative Example 11 | CGM5 | HTM2-1 | 4 | CTB1 | 16 | ETM1-1 | 0.1 | F1 | 1 |
| Comparative Example 12 | CGM6 | HTM2-1 | 4 | CTB1 | 16 | ETM1-1 | 0.1 | F1 | 1 |

TABLE 15-continued

| | Charge generation layer condition CGM | Charge transport layer condition | | | | | | | |
|---|---|---|---|---|---|---|---|---|---|
| | | HTM | | CTB | | ETM | | Inorganic oxide | |
| | Type | Type | Amount | Type | Amount | Type | Amount | Type | Amount |
| Comparative Example 13 | CGM1 | II-13 | 4 | CTB1 | 16 | ETM1-1 | 0.1 | F1 | 1 |
| Comparative Example 14 | CGM1 | II-23 | 4 | CTB1 | 16 | ETM1-1 | 0.1 | F1 | 1 |
| Comparative Example 15 | CGM1 | II-30 | 4 | CTB1 | 16 | ETM1-1 | 0.1 | F1 | 1 |
| Comparative Example 16 | CGM1 | HTM1-1 | 4 | CTB1 | 16 | ETM1-1 | 0.1 | F1 | 0 |
| Comparative Example 17 | CGM1 | HTM2-1 | 4 | CTB1 | 16 | ETM1-1 | 0.1 | F1 | 0 |

TABLE 16

| | Charge transport layer condition | | | | | | | | |
|---|---|---|---|---|---|---|---|---|---|
| | HTM | CTB | ETM | Inorganic oxide | | | | | |
| | Ratios in solid content | | | | Ratios | | | | |
| | a | b | c | d | b/a | c/a | d/a | c + d | c/d |
| Comparative Example 1 | 0.403 | 0.545 | 0.005 | 0.047 | 1.35 | 0.012 | 0.118 | 0.052 | 0.100 |
| Comparative Example 2 | 0.190 | 0.762 | 0.000 | 0.048 | 4.00 | 0.003 | 0.250 | 0.048 | 0.010 |
| Comparative Example 3 | 0.198 | 0.790 | 0.005 | 0.007 | 4.00 | 0.025 | 0.038 | 0.012 | 0.667 |
| Comparative Example 4 | 0.130 | 0.736 | 0.004 | 0.130 | 5.67 | 0.033 | 1.000 | 0.134 | 0.033 |
| Comparative Example 5 | 0.190 | 0.758 | 0.005 | 0.047 | 4.00 | 0.025 | 0.250 | 0.052 | 0.100 |
| Comparative Example 6 | 0.190 | 0.758 | 0.005 | 0.047 | 4.00 | 0.025 | 0.250 | 0.052 | 0.100 |
| Comparative Example 7 | 0.190 | 0.758 | 0.005 | 0.047 | 4.00 | 0.025 | 0.250 | 0.052 | 0.100 |
| Comparative Example 8 | 0.190 | 0.758 | 0.005 | 0.047 | 4.00 | 0.025 | 0.250 | 0.052 | 0.100 |
| Comparative Example 9 | 0.190 | 0.758 | 0.005 | 0.047 | 4.00 | 0.025 | 0.250 | 0.052 | 0.100 |
| Comparative Example 10 | 0.190 | 0.758 | 0.005 | 0.047 | 4.00 | 0.025 | 0.250 | 0.052 | 0.100 |
| Comparative Example 11 | 0.190 | 0.758 | 0.005 | 0.047 | 4.00 | 0.025 | 0.250 | 0.052 | 0.100 |
| Comparative Example 12 | 0.190 | 0.758 | 0.005 | 0.047 | 4.00 | 0.025 | 0.250 | 0.052 | 0.100 |
| Comparative Example 13 | 0.190 | 0.758 | 0.005 | 0.047 | 4.00 | 0.025 | 0.250 | 0.052 | 0.100 |
| Comparative Example 14 | 0.190 | 0.758 | 0.005 | 0.047 | 4.00 | 0.025 | 0.250 | 0.052 | 0.100 |
| Comparative Example 15 | 0.190 | 0.758 | 0.005 | 0.047 | 4.00 | 0.025 | 0.250 | 0.052 | 0.100 |
| Comparative Example 16 | 0.199 | 0.796 | 0.005 | 0.000 | 4.00 | 0.025 | 0.000 | 0.005 | — |
| Comparative Example 17 | 0.199 | 0.796 | 0.005 | 0.000 | 4.00 | 0.025 | 0.000 | 0.005 | — |

<Evaluation of Photoconductor>

Electric characteristics of the photoconductors prepared in the Examples 1 to 47 and Comparative Examples 1 to 17 were evaluated by the following methods. Evaluation results are also shown in Tables below.

<Electric Characteristic>

Electric characteristics of the photoconductors acquired in Examples and Comparative Examples were evaluated by the following method by use of a process simulator (CYNTHIA91) manufactured by GEN-TECH, INC.

With regard to each photoconductor in Examples 1 to 47 and Comparative Examples 1 to 17, the surface of the photoconductor was charged to −650 V by corona discharge in a dark place in an environment of a temperature of 22° C. and humidity of 50%, and then the surface potential V0 immediately after the charging was measured. Subsequently, the photoconductor was left to stand for 5 seconds in the dark place, and then the surface potential V5 was measured and a potential retention rate Vk5(%) at a time point 5 seconds after the charging was calculated in accordance with the following equation (2):

$$Vk5=V5/V0\times100 \quad (2).$$

Next, with a halogen lamp as a light source, the photoconductor was irradiated for 5 seconds with exposure light at 1.0 ρW/cm$^2$ dispersed to 780 nm by use of a filter from a time point of the surface potential reaching −600 V, and an exposure value required for light attenuation making the surface potential −300 V was evaluated as E½ (μJ/cm$^2$).

The electric characteristic measurement was performed before and after a print evaluation described in the following actual machine characteristic, and variations of values after printing relative to values before printing in an actual machine, that is, ΔVk5 (potential retention rate variation) and ΔE½ (sensitivity variation), were calculated and compared.

<Actual Machine Characteristic>

Each photoconductor prepared in Examples 1 to 47 and Comparative Examples 1 to 17 was equipped on a digital copier (imageRUNNER ADVANCE C5030 manufactured by Canon, Inc.), and amounts of film scraping before and after printing 40,000 sheets were evaluated as an indicator of abrasion resistance. Specifically, film thicknesses of the photoconductor before and after the printing were measured, the difference between the two was calculated, and an average amount of abrasion (μm) after the printing was evaluated.

Further, as evaluation of an image defect, a halftone image was printed in the initial stage and after printing 40,000 sheets, and a white spot defect on the halftone and relating filming on the photoconductor were observed. A case of no defect on a printing image and no adhering toner on the photoconductor is represented by ○, and a case of a white spot defect existing on a halftone and adhering toner existing in a part relating to the image defect on the photoconductor is represented by x.

The results are collectively described in the following Tables.

TABLE 17

| | Abrasion resistance (average amount of abrasion) (μm) | Filming | Sensitivity variation (before-after) ΔE1/2 (%) | Potential retention rate variation (before-after) ΔVk5 (%) |
|---|---|---|---|---|
| Example 1 | 1.71 | ○ | 8.9 | 3.7 |
| Example 2 | 1.49 | ○ | 11.0 | 4.6 |
| Example 3 | 1.36 | ○ | 12.7 | 5.0 |
| Example 4 | 1.87 | ○ | 9.1 | 3.2 |
| Example 5 | 1.73 | ○ | 7.7 | 3.1 |
| Example 6 | 1.75 | ○ | 6.5 | 2.6 |
| Example 7 | 1.70 | ○ | 22.0 | 7.9 |
| Example 8 | 1.66 | ○ | 13.3 | 5.2 |
| Example 9 | 1.73 | ○ | 19.0 | 6.9 |
| Example 10 | 1.50 | ○ | 18.5 | 8.0 |
| Example 11 | 1.97 | ○ | 11.1 | 4.3 |
| Example 12 | 1.80 | ○ | 7.8 | 3.0 |
| Example 13 | 1.72 | ○ | 9.8 | 3.8 |
| Example 14 | 1.78 | ○ | 10.2 | 4.0 |
| Example 15 | 1.71 | ○ | 12.3 | 4.2 |
| Example 16 | 1.82 | ○ | 9.6 | 4.3 |
| Example 17 | 1.68 | ○ | 11.0 | 4.1 |
| Example 18 | 1.69 | ○ | 10.0 | 3.9 |
| Example 19 | 1.68 | ○ | 12.4 | 3.9 |

TABLE 17-continued

| | Abrasion resistance (average amount of abrasion) (μm) | Filming | Sensitivity variation (before-after) ΔE1/2 (%) | Potential retention rate variation (before-after) ΔVk5 (%) |
|---|---|---|---|---|
| Example 20 | 1.77 | ○ | 9.9 | 4.0 |
| Example 21 | 1.80 | ○ | 10.1 | 4.2 |
| Example 22 | 1.88 | ○ | 10.5 | 3.8 |
| Example 23 | 1.75 | ○ | 9.8 | 4.0 |

TABLE 18

| | Abrasion resistance (average amount of abrasion) (μm) | Filming | Sensitivity variation (before-after) ΔE1/2 (%) | Potential retention rate variation (before-after) ΔVk5 (%) |
|---|---|---|---|---|
| Example 24 | 1.82 | ○ | 11.1 | 4.4 |
| Example 25 | 1.73 | ○ | 12.0 | 3.7 |
| Example 26 | 1.70 | ○ | 10.0 | 4.0 |
| Example 27 | 1.79 | ○ | 12.9 | 4.5 |
| Example 28 | 1.72 | ○ | 13.6 | 3.9 |
| Example 29 | 1.73 | ○ | 10.5 | 3.8 |
| Example 30 | 1.74 | ○ | 10.1 | 3.8 |
| Example 31 | 1.75 | ○ | 12.8 | 4.0 |
| Example 32 | 1.80 | ○ | 11.0 | 4.4 |
| Example 33 | 1.88 | ○ | 9.9 | 4.2 |
| Example 34 | 1.86 | ○ | 10.7 | 4.8 |
| Example 35 | 1.90 | ○ | 10.4 | 4.4 |
| Example 36 | 1.59 | ○ | 10.1 | 5.1 |
| Example 37 | 1.67 | ○ | 10.7 | 5.3 |
| Example 38 | 1.63 | ○ | 10.2 | 6.2 |
| Example 39 | 1.69 | ○ | 11.0 | 5.9 |
| Example 40 | 1.95 | ○ | 9.2 | 5.4 |
| Example 41 | 1.62 | ○ | 6.9 | 6.5 |
| Example 42 | 1.90 | ○ | 8.8 | 7.1 |
| Example 43 | 1.57 | ○ | 10.9 | 4.1 |
| Example 44 | 2.52 | ○ | 9.9 | 4.5 |
| Example 45 | 2.45 | ○ | 12.0 | 5.5 |
| Example 46 | 1.73 | ○ | 19.5 | 8.9 |
| Example 47 | 1.72 | ○ | 19.2 | 8.8 |

TABLE 19

| | Abrasion resistance (average amount of abrasion) (μm) | Filming | Sensitivity variation (before-after) ΔE1/2 (%) | Potential retention rate variation (before-after) ΔVk5 (%) |
|---|---|---|---|---|
| Comparative Example 1 | 5.50 | ○ | 4.0 | 1.6 |
| Comparative Example 2 | 1.71 | ○ | 25.0 | 9.0 |
| Comparative Example 3 | 2.80 | ○ | 7.7 | 3.1 |
| Comparative Example 4 | 1.24 | × | 23.1 | 9.2 |
| Comparative Example 5 | 1.81 | ○ | 45.0 | 15.1 |
| Comparative Example 6 | 1.75 | ○ | 32.0 | 36.2 |
| Comparative Example 7 | 1.78 | ○ | 102.0 | 30.1 |
| Comparative Example 8 | 1.78 | ○ | 82.1 | 28.8 |
| Comparative Example 9 | 1.81 | ○ | 55.7 | 21.0 |
| Comparative Example 10 | 1.75 | ○ | 46.2 | 37.2 |

TABLE 19-continued

| | Abrasion resistance (average amount of abrasion) (μm) | Filming | Sensitivity variation (before-after) ΔE1/2 (%) | Potential retention rate variation (before-after) ΔVk5 (%) |
|---|---|---|---|---|
| Comparative Example 11 | 1.78 | ○ | 122.8 | 31.4 |
| Comparative Example 12 | 1.78 | ○ | 95.1 | 29.8 |
| Comparative Example 13 | 1.92 | ○ | 76.3 | 20.1 |
| Comparative Example 14 | 1.83 | ○ | 120.8 | 19.3 |
| Comparative Example 15 | 1.79 | ○ | 142.4 | 19.0 |
| Comparative Example 16 | 2.95 | ○ | 10.2 | 4.6 |
| Comparative Example 17 | 2.99 | ○ | 13.6 | 5.2 |

From the results in the above Tables, it is understood that the photoconductors in Examples 1 to 47 have excellent abrasion resistance, exhibit no filming, and have excellent image quality in the initial stage and after printing 40,000 sheets, and particularly exhibit a low amount of decrease in a potential retention rate and have excellent electric characteristics as photoconductors. On the other hand, the photoconductors in Comparative Examples 1 to 17 exhibit a large amount of film abrasion after long-term printing or occurrence of filming therein; and decrease in a potential retention rate was also confirmed. Although the mechanism is unclear, it is confirmed that the use of a hole transport material and a charge generation material with specific structures improves abrasion resistance, filming resistance, and electric characteristics in the photoconductors in Examples 1 to 47.

From the above, it is confirmed that by using a photosensitive layer satisfying the conditions according to the present invention, an electrophotographic photoconductor suppressing abrasion, eliminating filming, and having an excellent potential retention rate in long-term printing is acquired.

DESCRIPTION OF SYMBOLS

1 Electroconductive substrate
2 Undercoating layer
3 Charge generation layer
4 Charge transport layer
5 Photosensitive layer
8 Photoconductor
21 Charged member
22 High voltage power source
23 Image exposure member
24 Development device
241 Development roller
25 Paper feeding member
251 Paper feeding roller
252 Paper feeding guide
26 Transfer charger (direct charging type)
27 Cleaning device
271 Cleaning blade
60 Electrophotographic device
300 Photosensitive layer

What is claimed is:

1. An electrophotographic photoconductor, comprising:

an electroconductive substrate; and a photosensitive layer provided on the electroconductive substrate and successively including:

a charge generation layer containing a charge generation material disposed on the electroconductive substrate; and a charge transport layer disposed on the charge generation layer and containing a hole transport material having a mass denoted by a and a structure expressed by general formula (A-1) below, a charge transport layer resin binder having a mass denoted by b, an electron transport material having a mass denoted by c, and an inorganic oxide having a mass denoted by d, and a, b, c, and d satisfy conditions expressed by equations 1 to 5 below:

$1.5 \leq b/a \leq 5.7$, equation 1

$0.005 \leq c/a \leq 0.35$, equation 2

$0.05 \leq d/a \leq 0.70$, equation 3

$a \geq c+d$, and equation 4

$c/d \geq 0.01$, equation 5 wherein the charge generation material contains titanyl phthalocyanine having an exothermic peak at 251±5° C., a half-value width of the exothermic peak equal to or less than 15° C., and a heating value equal to or greater than 1.0 mJ/mg when a temperature rise condition is 20° C./min in differential scanning calorimetry and having a diffraction peak at 27.2±0.3° in X-ray diffraction, and wherein the structure expressed by general formula (A-1) is:

(A-1)

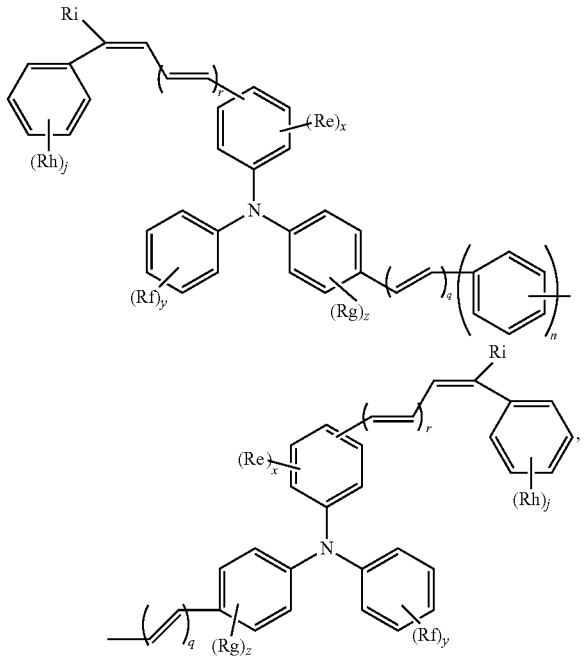

where, each of Re, Rf, Rg, and Ri independently represents a hydrogen atom, a branched or unbranched alkyl group having 1 to 6 carbon atoms, an alkoxy group having 1 to 3 carbon atoms, a substituted or unsubstituted phenyl group, or a substituted or unsubstituted styryl group, Rh represents a hydrogen atom, a branched or unbranched alkyl group having 1 to 6 carbon atoms, an alkoxy group having 1 to 3 carbon atoms, a substituted or unsubstituted phenyl group, a substituted or unsubstituted styryl group, or a structural unit expressed by general formula (Rh1) or (Rh2) below, x and z each denote an integer in a range of 0 to 4, j and y each denote an integer in a range of 0 to 5, n denotes an integer of 1 or 2, q denotes an integer in a range of 0 to 2, and r denotes an integer of 0 or 1, (Rh1)

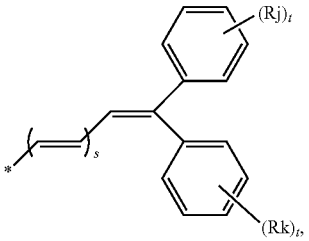

(Rh2)

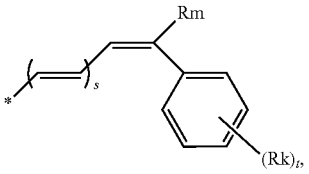

where, in the formulae (Rh1) and (Rh2), each of Rj, Rk, and Rm independently represents a hydrogen atom or an alkyl group having 1 to 3 carbon atoms, t denotes an integer in a range of 0 to 5, s denotes an integer of 0 or 1, and

* denotes a binding site.

2. The electrophotographic photoconductor according to claim 1, wherein the electron transport material contains one or more compounds expressed by structural formulae (E-1) to (E-5) below:

(E-1)

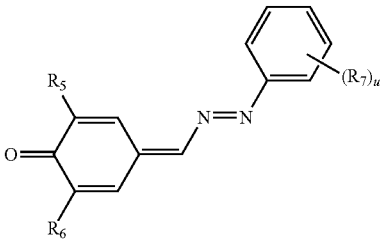

(E-2)

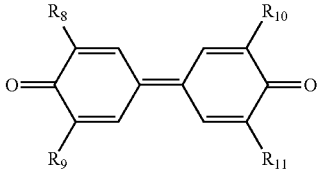

-continued (E-3)

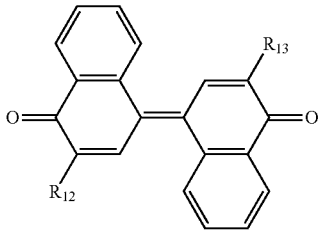

(E-4)

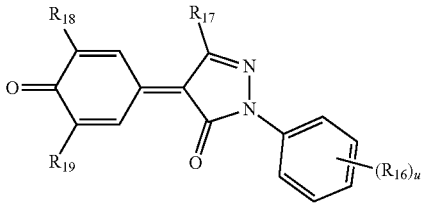

(E-5)

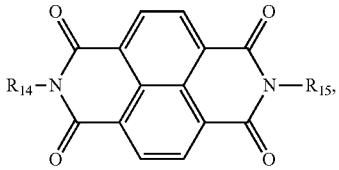

where, in the formulae (E-1), (E-2), (E-3), and (E-4), each of $R_5$, $R_6$, $R_7$, $R_8$, $R_9$, $R_{10}$, $R_{11}$, $R_{12}$, $R_{13}$, $R_{16}$, $R_{17}$, $R_{18}$, and $R_{19}$ independently represents a hydrogen atom, a halogen atom, a nitro group, a cyano group, an alkyl group having 1 to 6 carbon atoms that may have a substituent, an alkenyl group having 2 to 6 carbon atoms that may have a substituent, an alkoxy group having 1 to 6 carbon atoms that may have a substituent, an aryl group having 6 to 14 carbon atoms that may have a substituent, or a cycloalkyl group having 3 to 8 carbon atoms that may have a substituent, and u denotes an integer in a range of 0 to 5;

where, in the formula (E-5), each of $R_{14}$ and $R_{15}$ independently represents an aryl group having 6 to 14 carbon atoms that may have at least one alkyl group having 1 to 6 carbon atoms, an aryl group having 6 to 14 carbon atoms that may have a phenylcarbonyl group, an aralkyl group having 7 to 20 carbon atoms, an alkoxy group having 1 to 6 carbon atoms, an alkyl group having 1 to 8 carbon atoms that may have an alkylamino group, or a cycloalkyl group having 3 to 10 carbon atoms; and a selected group may be substituted by one or more halogen atoms.

3. The electrophotographic photoconductor according to claim 2, wherein the charge transport layer resin binder contains a resin having a viscosity-equivalent molecular weight equal to or greater than 15,000 and having a repeating unit expressed by structural formula (BD-1) below:

(BD-1)

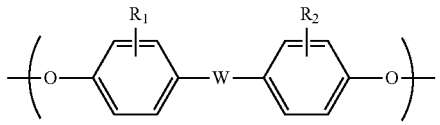

where each of $R_1$ and $R_2$ represents a hydrogen atom or an alkyl group having 1 to 3 carbon atoms, W represents a single bond, an oxygen atom, a sulfur atom, or $CR_3R_4$ where $R_3$ and $R_4$ may each independently represent a hydrogen atom or an alkyl group having 1 to 3 carbon atoms or may be bonded to each other to form a substituted or unsubstituted cycloalkyl group having 5 to 6 carbon atoms.

4. The electrophotographic photoconductor according to claim 3, wherein the inorganic oxide contains silica as a main component and aluminum in an amount equal to or greater than 1 ppm and equal to or less than 2000 ppm, and is subjected to surface treatment with a silane coupling agent having a structure expressed by general formula (1) below:

$$(R^{21})_n—Si—(OR^{22})_{4-n} \quad (1),$$

where Si represents a silicon atom, $R^{21}$ represents an organic group formed by directly bonding carbon to the silicon atom, $R^{22}$ represents an organic group, and n denotes an integer in a range of 0 to 3.

5. The electrophotographic photoconductor according to claim 4, wherein the silane coupling agent contains a material selected from the group consisting of phenyltrimethoxysilane, vinyltrimethoxysilane, epoxytrimethoxysilane, methacryltrimethoxysilane, aminotrimethoxysilane, ureidotrimethoxysilane, mercaptopropyltrimethoxysilane, isocyanatepropyltrimethoxysilane, phenylaminotrimethoxysilane, acryltrimethoxysilane, p-styryltrimethoxysilane, 3-acryloxypropyltrimethoxysilane, 3-methacryloxypropyltrimethoxysilane, 3-isocyanatepropyltrimethoxysilane, 3-aminopropyltrimethoxysilane, N-phenyl-3-aminopropyltrimethoxysilane, and combinations thereof.

6. The electrophotographic photoconductor according to claim 4, wherein the inorganic oxide is subjected to surface treatment with a plurality of types of the silane coupling agents, and a silane coupling agent first used in the surface treatment has a structure expressed by the general formula (1).

7. The electrophotographic photoconductor according to claim 2, wherein the inorganic oxide contains silica as a main component and aluminum in an amount equal to or greater than 1 ppm and equal to or less than 2000 ppm, and is subjected to surface treatment with a silane coupling agent having a structure expressed by general formula (1) below:

$$(R^{21})_n—Si—(OR^{22})_{4-n} \quad (1),$$

where Si represents a silicon atom, $R^{21}$ represents an organic group formed by directly bonding carbon to the silicon atom, $R^{22}$ represents an organic group, and n denotes an integer in a range of 0 to 3.

8. The electrophotographic photoconductor according to claim 7, wherein the silane coupling agent contains a material selected from the group consisting of phenyltrimethoxysilane, vinyltrimethoxysilane, epoxytrimethoxysilane, methacryltrimethoxysilane, aminotrimethoxysilane, ureidotrimethoxysilane, mercaptopropyltrimethoxysilane, isocyanatepropyltrimethoxysilane, phenylaminotrimethoxysilane, acryltrimethoxysilane, p-styryltrimethoxysilane, 3-acryloxypropyltrimethoxysilane, 3-methacryloxypropyltrimethoxysilane, 3-isocyanatepropyltrimethoxysilane, 3-aminopropyltrimethoxysilane, N-phenyl-3-aminopropyltrimethoxysilane, and combinations thereof.

9. The electrophotographic photoconductor according to claim 7, wherein the inorganic oxide is subjected to surface treatment with a plurality of types of the silane coupling agents, and a silane coupling agent first used in the surface treatment has a structure expressed by the general formula (1).

10. The electrophotographic photoconductor according to claim 1, wherein the resin binder contains a resin having a viscosity-equivalent molecular weight equal to or greater than 15,000 and having a repeating unit expressed by structural formula (BD-1) below:

(BD-1)

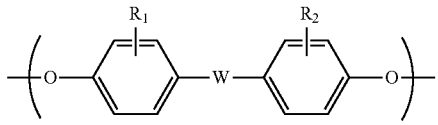

where each of $R_1$ and $R_2$ represents a hydrogen atom or an alkyl group having 1 to 3 carbon atoms, W represents a single bond, an oxygen atom, a sulfur atom, or $CR_3R_4$ where $R_3$ and $R_4$ may each independently represent a hydrogen atom or an alkyl group having 1 to 3 carbon atoms or may be bonded to each other to form a substituted or unsubstituted cycloalkyl group having 5 to 6 carbon atoms.

11. The electrophotographic photoconductor according to claim 10, wherein the inorganic oxide contains silica as a main component and aluminum in an amount equal to or greater than 1 ppm and equal to or less than 2000 ppm, and is subjected to surface treatment with a silane coupling agent having a structure expressed by general formula (1) below:

$$(R^{21})_n—Si—(OR^{22})_{4-n} \quad (1),$$

where Si represents a silicon atom, $R^{21}$ represents an organic group formed by directly bonding carbon to the silicon atom, $R^{22}$ represents an organic group, and n denotes an integer in a range of 0 to 3.

12. The electrophotographic photoconductor according to claim 11, wherein the silane coupling agent contains a material selected from the group consisting of phenyltrimethoxysilane, vinyltrimethoxysilane, epoxytrimethoxysilane, methacryltrimethoxysilane, aminotrimethoxysilane, ureidotrimethoxysilane, mercaptopropyltrimethoxysilane, isocyanatepropyltrimethoxysilane, phenylaminotrimethoxysilane, acryltrimethoxysilane, p-styryltrimethoxysilane, 3-acryloxypropyltrimethoxysilane, 3-methacryloxypropyltrimethoxysilane, 3-isocyanatepropyltrimethoxysilane, 3-aminopropyltrimethoxysilane, N-phenyl-3-aminopropyltrimethoxysilane, and combinations thereof.

13. The electrophotographic photoconductor according to claim 11, wherein the inorganic oxide is subjected to surface treatment with a plurality of types of the silane coupling agents, and a silane coupling agent first used in the surface treatment has a structure expressed by the general formula (1).

14. The electrophotographic photoconductor according to claim 1, wherein the inorganic oxide contains silica as a main component and aluminum in an amount equal to or greater than 1 ppm and equal to or less than 2000 ppm, and is subjected to surface treatment with a silane coupling agent having a structure expressed by general formula (1) below:

$$(R^{21})_n—Si—(OR^{22})_{4-n} \quad (1),$$

where Si represents a silicon atom, $R^{21}$ represents an organic group formed by directly bonding carbon to the silicon atom, $R^{22}$ represents an organic group, and n denotes an integer in a range of 0 to 3.

15. The electrophotographic photoconductor according to claim 14, wherein the silane coupling agent contains a material selected from the group consisting of phenyltrimethoxysilane, vinyltrimethoxysilane, epoxytrimethoxysilane, methacryltrimethoxysilane, aminotrimethoxysilane, ureidotrimethoxysilane, mercaptopropyltrimethoxysilane, isocyanatepropyltrimethoxysilane, phenylaminotrimethoxysilane, acryltrimethoxysilane, p-styryltrimethoxysilane, 3-acryloxypropyltrimethoxysilane, 3-methacryloxypropyltrimethoxysilane, 3-isocyanatepropyltrimethoxysilane, 3-aminopropyltrimethoxysilane, N-phenyl-3-aminopropyltrimethoxysilane, and combinations thereof.

16. The electrophotographic photoconductor according to claim 14, wherein the inorganic oxide is subjected to surface treatment with a plurality of types of the silane coupling agents, and a silane coupling agent first used in the surface treatment has a structure expressed by the general formula (1).

17. A method of manufacturing the electrophotographic photoconductor according to claim 1, comprising:

providing a charge generation layer coating liquid comprising the charge generation material;

dip coating the electroconductive substrate in the charge generation layer coating liquid to form the charge generation layer;

providing a charge transport layer coating liquid comprising the hole transport material, the resin binder, the electron transport material, and the inorganic oxide; and dip coating the substrate in the charge transport layer coating liquid to form the charge transport layer.

18. The method according to claim 17, further comprising drying the charge generation layer coating liquid after dip coating thereof onto the substrate to provide a dried coated substrate, before dip coating the charge transport layer coating liquid onto the dried coated substrate.

19. An electrophotographic device equipped with the electrophotographic photoconductor according to claim 1.

* * * * *